US011879679B2

(12) United States Patent
Lee et al.

(10) Patent No.: US 11,879,679 B2
(45) Date of Patent: Jan. 23, 2024

(54) REFRIGERATOR AND CONTROL METHOD THEREFOR

(71) Applicant: LG ELECTRONICS INC., Seoul (KR)

(72) Inventors: Donghoon Lee, Seoul (KR); Wookyong Lee, Seoul (KR); Chongyoung Park, Seoul (KR); Donghoon Lee, Seoul (KR); Seungseob Yeom, Seoul (KR); Yongjun Bae, Seoul (KR); Sunggyun Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/281,753

(22) PCT Filed: Oct. 1, 2019

(86) PCT No.: PCT/KR2019/012852
§ 371 (c)(1),
(2) Date: Mar. 31, 2021

(87) PCT Pub. No.: WO2020/071742
PCT Pub. Date: Apr. 9, 2020

(65) Prior Publication Data

US 2021/0389035 A1 Dec. 16, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/24* (2018.01)
*F25C 5/08* (2006.01)

(52) U.S. Cl.
CPC ..... *F25C 1/24* (2013.01); *F25C 5/08* (2013.01); *F25C 2400/10* (2013.01); *F25C 2400/14* (2013.01)

(58) Field of Classification Search
CPC ..... F25C 1/24; F25C 5/08; F25C 2400/10; F25C 2400/14
See application file for complete search history.

(56) References Cited

U.S. PATENT DOCUMENTS 9,234,688 B2 1/2016 Son et al.
9,534,821 B2 1/2017 Yoon et al.
(Continued)

FOREIGN PATENT DOCUMENTS

CN 102878743 1/2013
CN 105020965 11/2015
(Continued)

OTHER PUBLICATIONS

Translated_Sakamoto (Year: 2006).*
(Continued)

*Primary Examiner* — Elizabeth J Martin
*Assistant Examiner* — Samba Gaye
(74) *Attorney, Agent, or Firm* — KED & ASSOCIATES, LLP

(57) ABSTRACT

A refrigerator comprises: a storage chamber, a cooler, a first tray, a second tray, the first portion and the second portion being configured to define a space formed by the cell to receive a liquid to be phase-changed to form ice, a heater provided adjacent to at least one of the first tray or the second tray; and a controller configured to: operate the heater while the ice is being formed so that gas bubbles dissolved in the liquid within the cell move from a portion of space where the liquid that has phase-changed into the ice to another portion of the space where the liquid is in a fluid
(Continued)

state, and when a defrosting start condition is satisfied while the ice is being formed in the space of the cell, perform a defrosting process and reduce an amount of cold supplied by the cooler.

23 Claims, 14 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081702 |
| Jul. 6, 2019 | (KR) | 10-2019-0081715 |

(56) References Cited

U.S. PATENT DOCUMENTS

| | | | | |
|---|---|---|---|---|
| 2012/0198863 | A1* | 8/2012 | Hall | F25D 21/08 62/126 |
| 2013/0014536 | A1* | 1/2013 | Son | F25C 1/25 62/340 |
| 2014/0165598 | A1* | 6/2014 | Boarman | F25C 1/22 62/347 |
| 2014/0182325 | A1 | 7/2014 | Lee et al. | |
| 2016/0370085 | A1 | 12/2016 | Kim | |
| 2019/0219317 | A1* | 7/2019 | Yoon | F25C 1/04 |

FOREIGN PATENT DOCUMENTS

| | | | |
|---|---|---|---|
| EP | 2096384 | | 9/2009 |
| EP | 3059526 | | 8/2016 |
| JP | H01181062 | A * | 7/1989 |
| JP | H05-203299 | | 8/1993 |
| JP | H05-203302 | | 8/1993 |
| JP | H0819734 | A * | 1/1996 |
| JP | 09-269172 | | 10/1997 |
| JP | 2003-1114072 | | 4/2003 |
| JP | 2005326035 | | 11/2005 |
| JP | 2006275510 | A * | 10/2006 |
| JP | 2008-304074 | | 12/2008 |
| JP | 4572833 | | 11/2010 |
| JP | 2011-064371 | | 3/2011 |
| JP | 2011064373 | | 3/2011 |
| JP | 2011-237077 | | 11/2011 |
| KR | 10-1999-0017852 | | 3/1999 |
| KR | 1999017852 | A * | 3/1999 |
| KR | 200153893 | Y1 * | 8/1999 |
| KR | 10-2003-0051546 | | 6/2003 |
| KR | 10-2005-0069319 | | 7/2005 |
| KR | 10-2005-0096336 | | 10/2005 |
| KR | 10-0567864 | | 4/2006 |
| KR | 10-2013-0009332 | | 1/2013 |
| KR | 10-2013-0009521 | | 1/2013 |
| KR | 20130009332 | | 1/2013 |
| KR | 10-2014-0088321 | | 7/2014 |
| KR | 10-1643635 | | 7/2016 |
| KR | 10-2018-0007580 | | 1/2018 |
| KR | 10-1850918 | | 5/2018 |
| KR | 10-2018-0093666 | | 8/2018 |
| KR | 10-2018-0100752 | | 9/2018 |

OTHER PUBLICATIONS

Translated_Nakanishi (Year: 1999).*
Translated_Choi (Year: 1999).*
Translated_Nakamoto (Year: 1996).*
Translated_Ohashi (Year: 1989).*
International Search Report dated Jan. 16, 2020 issued in Application No. PCT/KR2019/012852.
Chinese Office Action dated May 27, 2022 issued in Application No. 201980064212.7.
European Search Report dated Jun. 28, 2022 issued in Application No. 19869043.0.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
Korean Office Action dated May 1, 2023 issued in Application No. 10-2018-0117785.
Korean Office Action dated Jul. 4, 2023 issued in Application No. 10-2018-0142117.
Korean Notice of Allowance dated Nov. 7, 2023, issued in Application No. 10-2018-0117821.

* cited by examiner

【FIG. 1B】
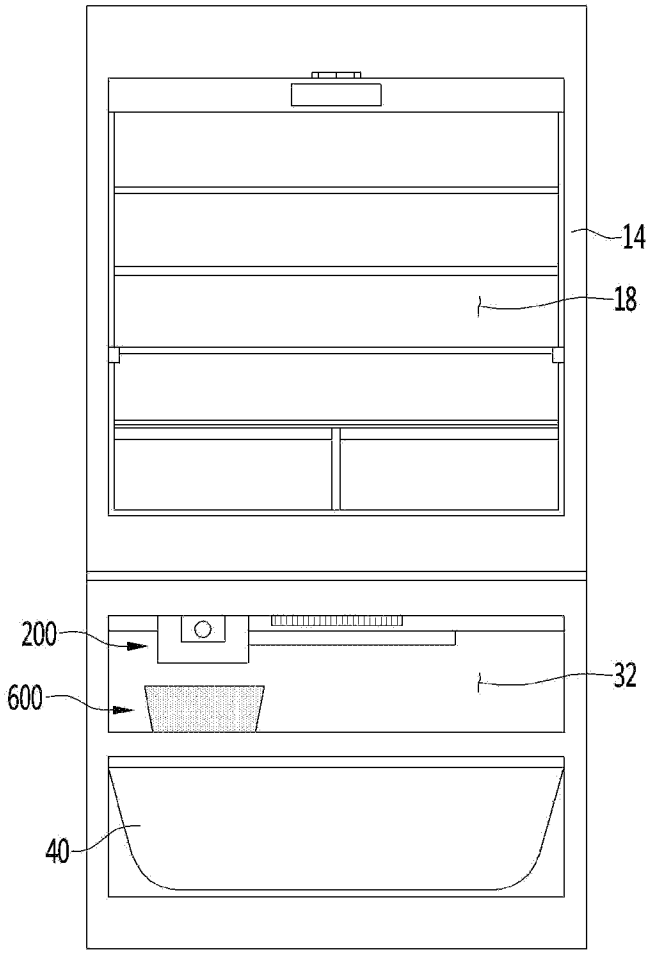
【FIG. 1A】
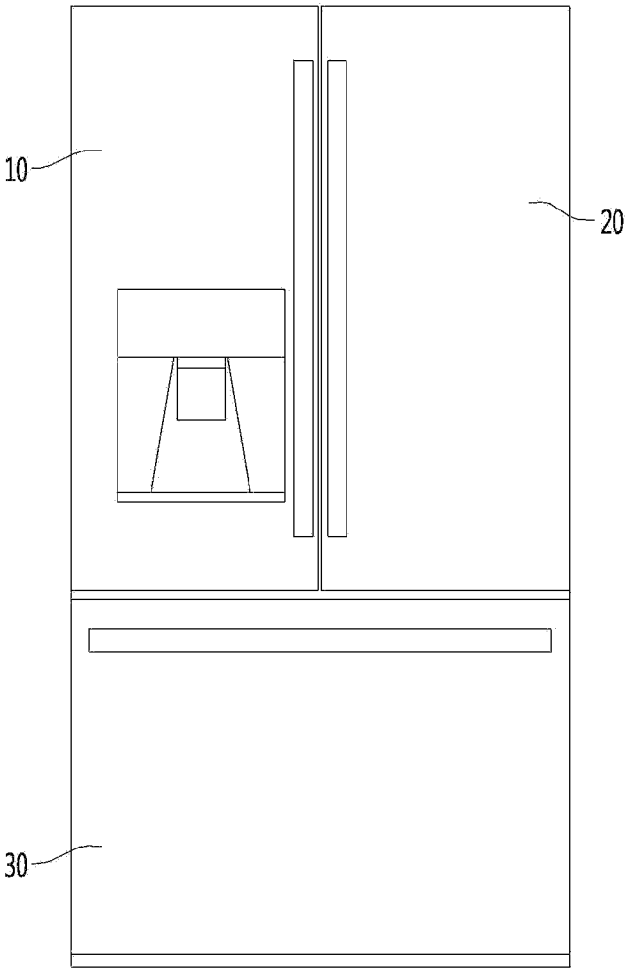

【FIG. 2】
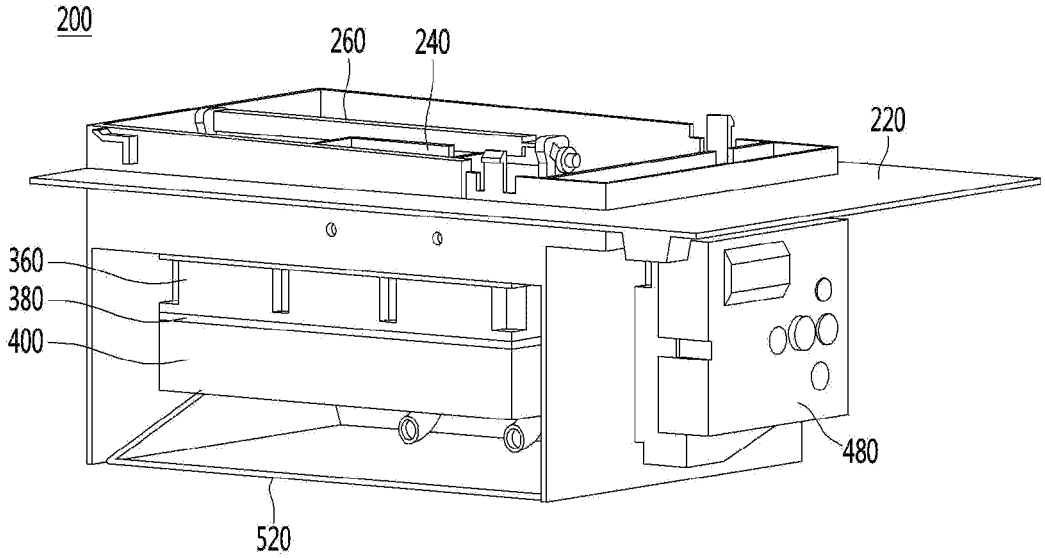
【FIG. 3】
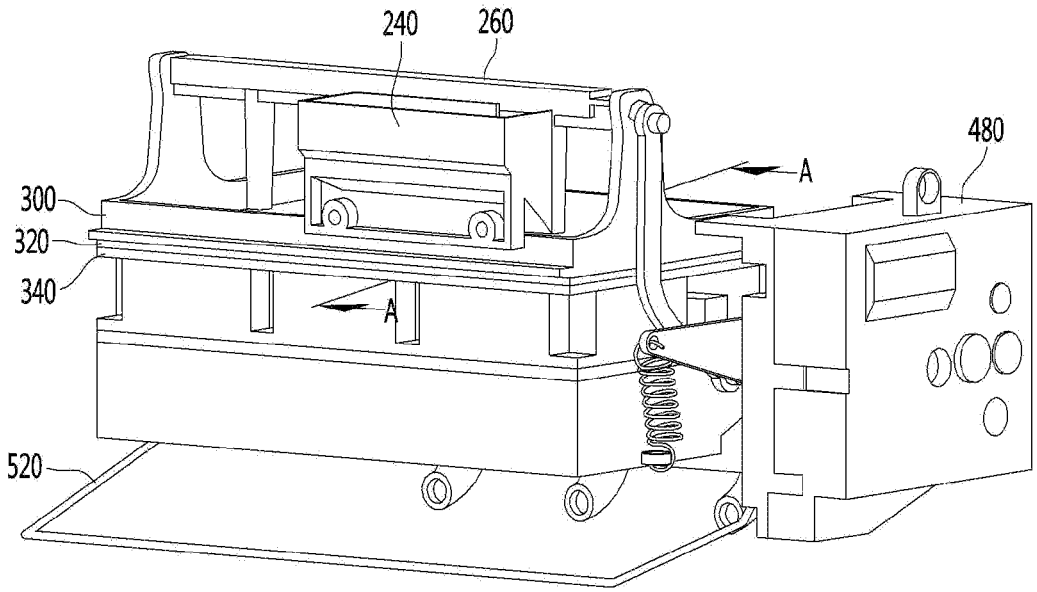

【FIG. 4】
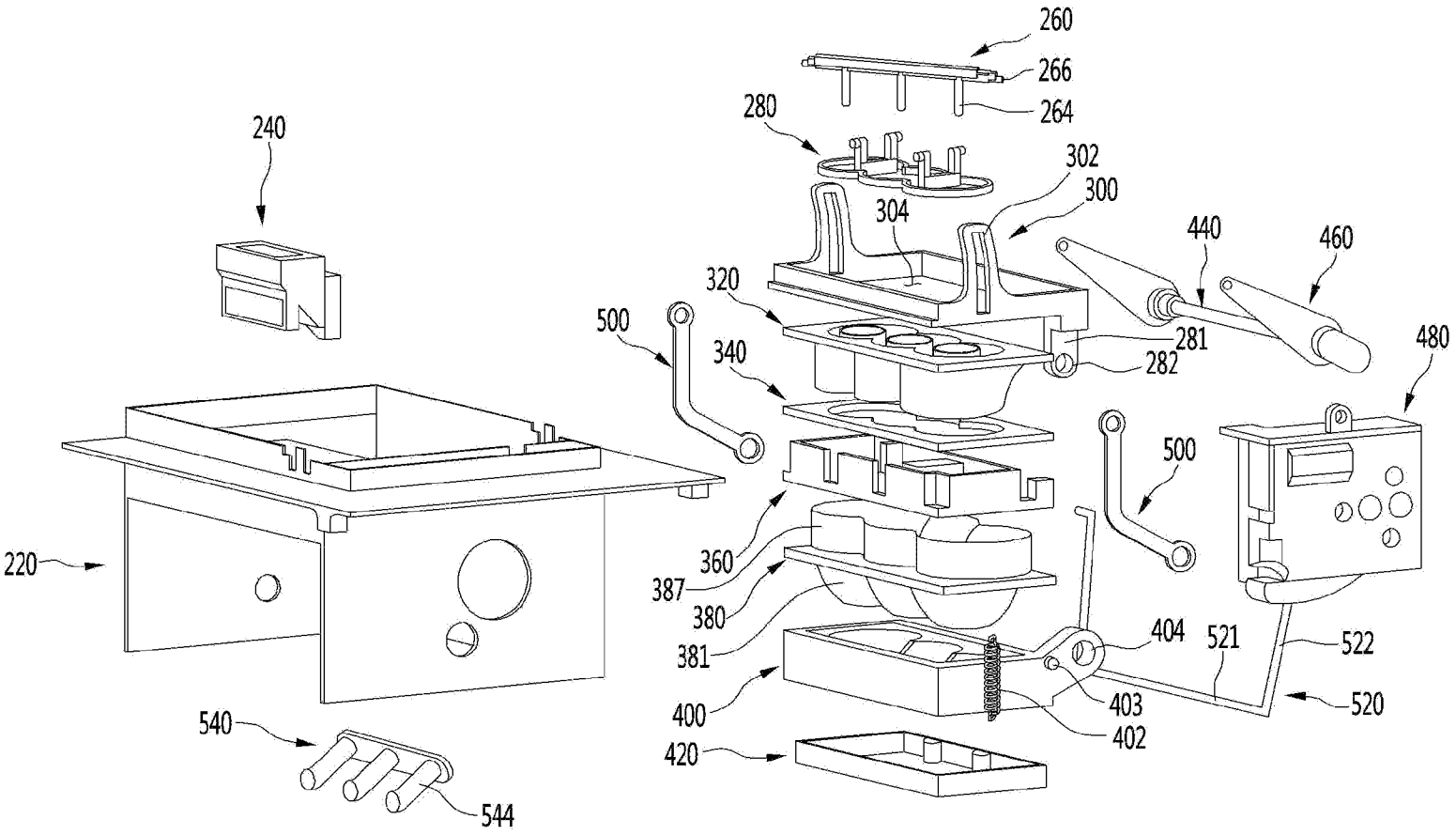

【FIG. 5】
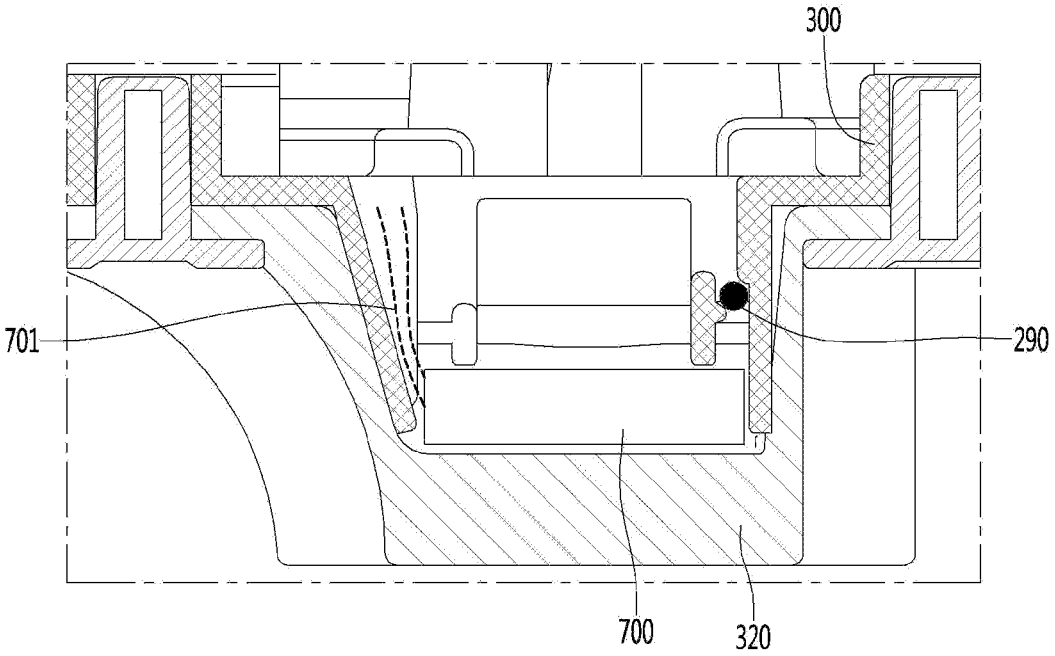

【FIG. 6】
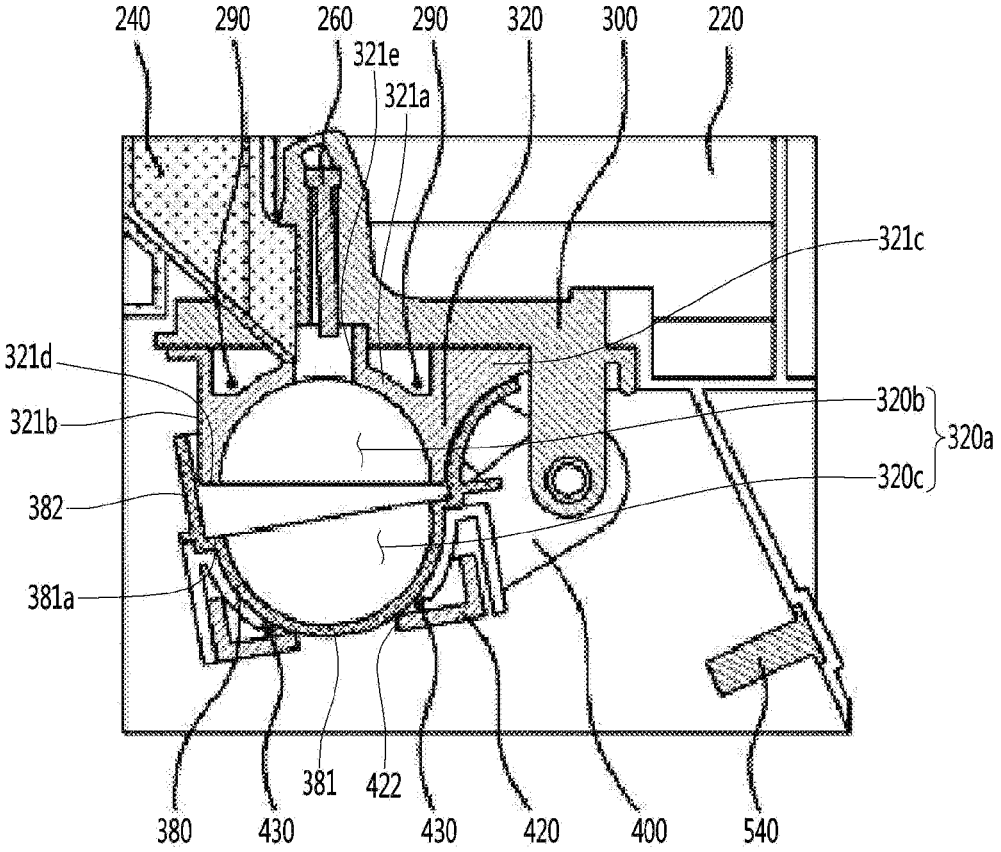

【FIG. 7】
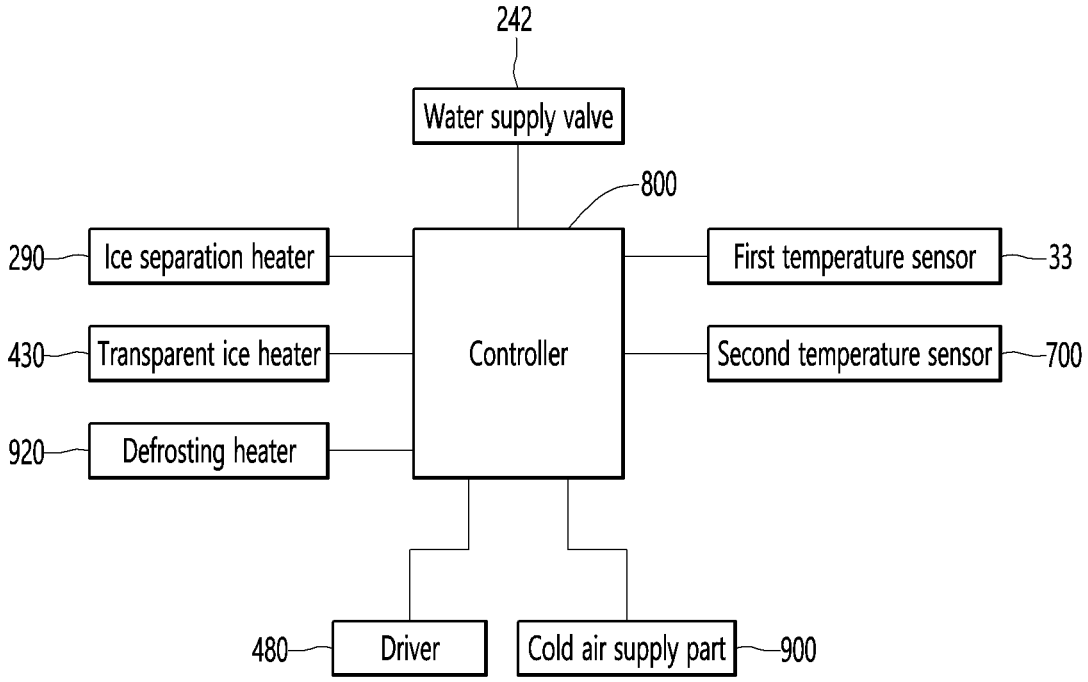

【FIG. 8】
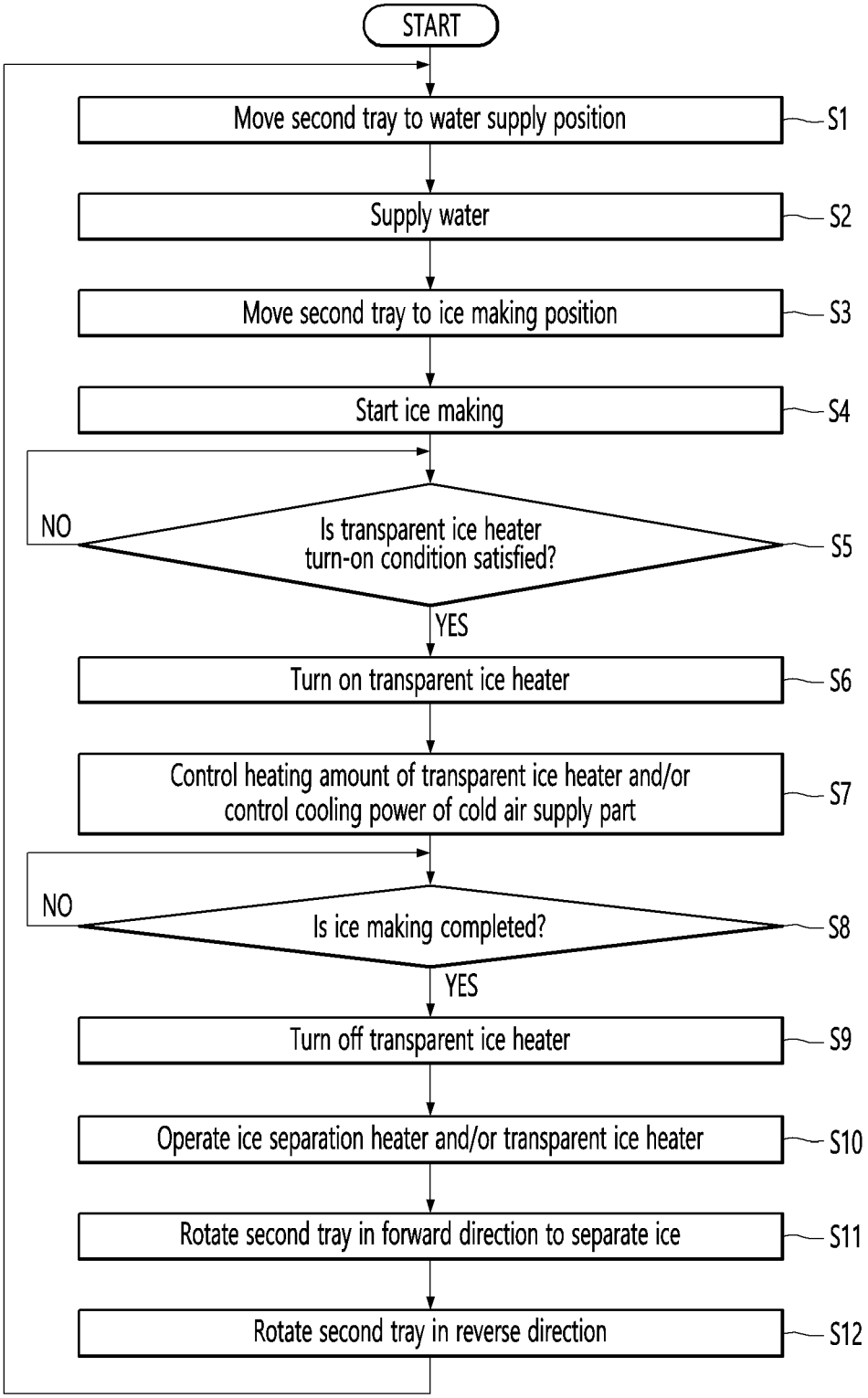

【FIG. 9A】
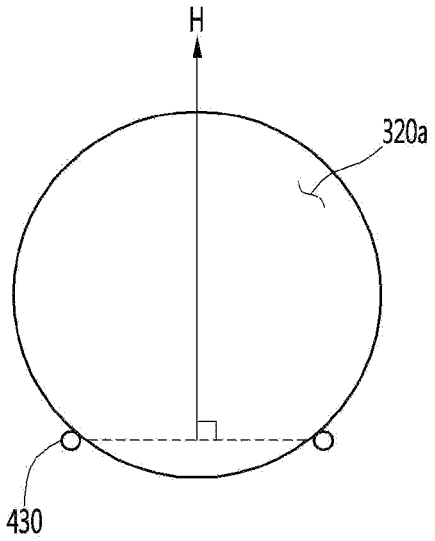
【FIG. 9B】
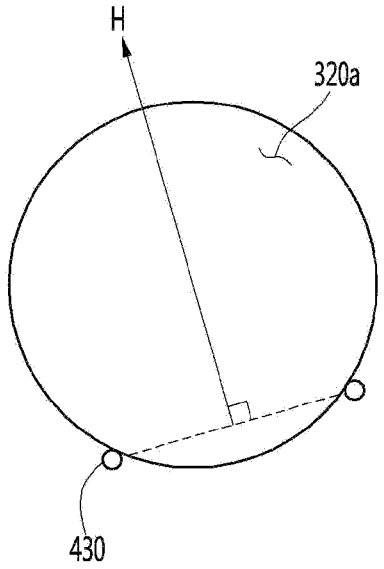
【FIG. 10A】
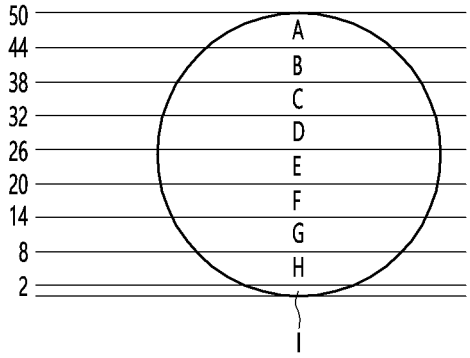
【FIG. 10B】
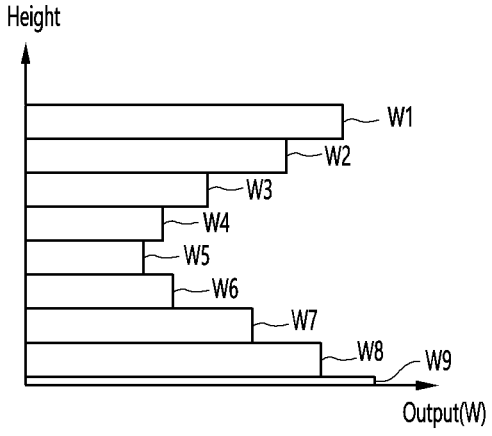

【FIG. 11】
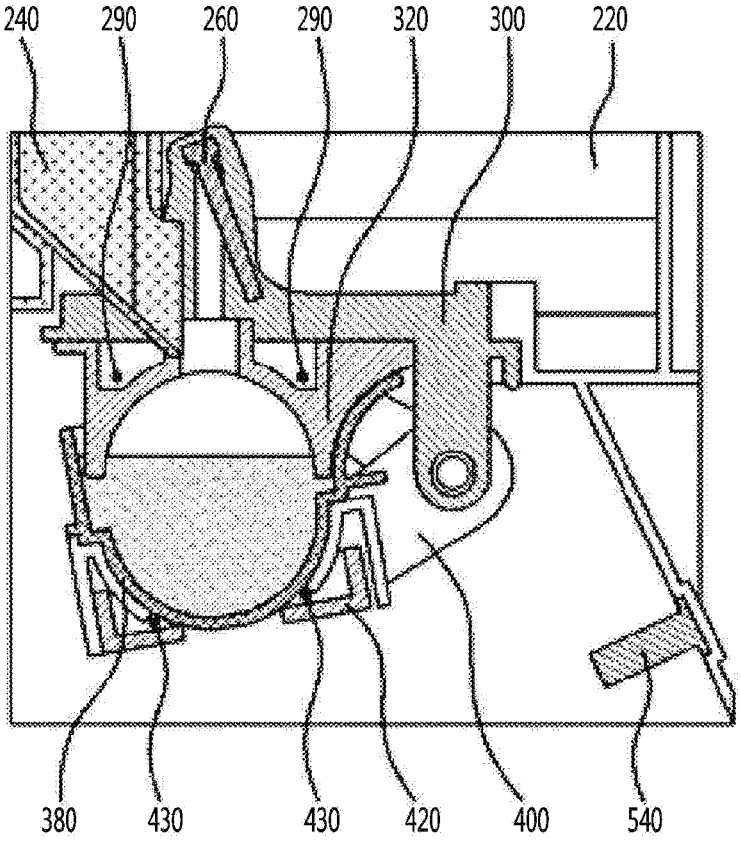

【FIG. 12】
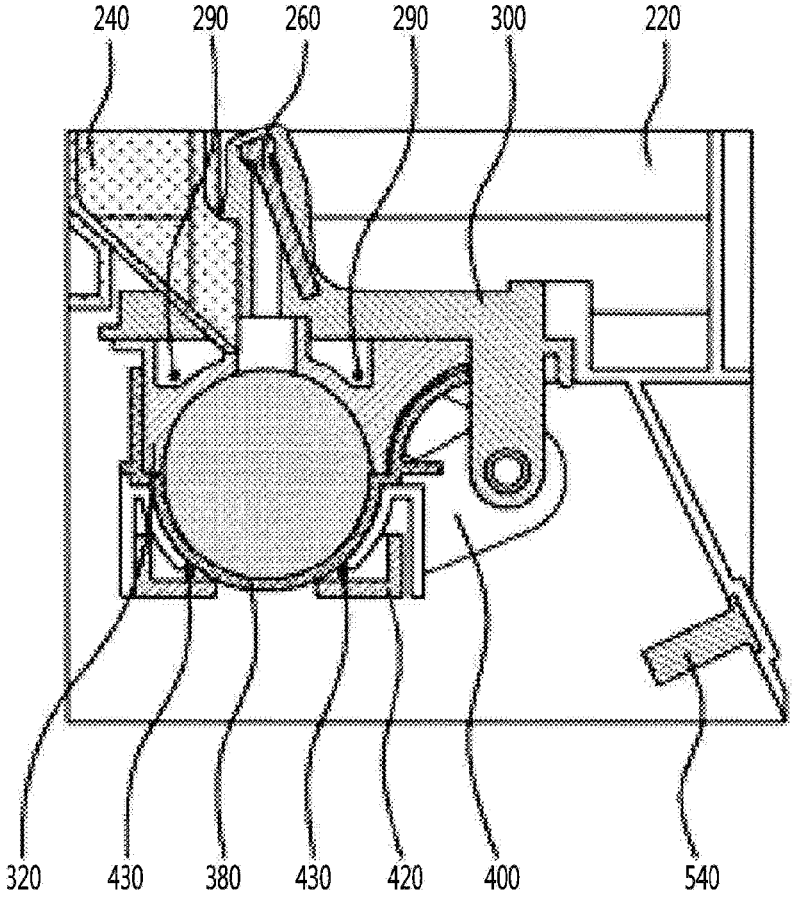

【FIG. 13】
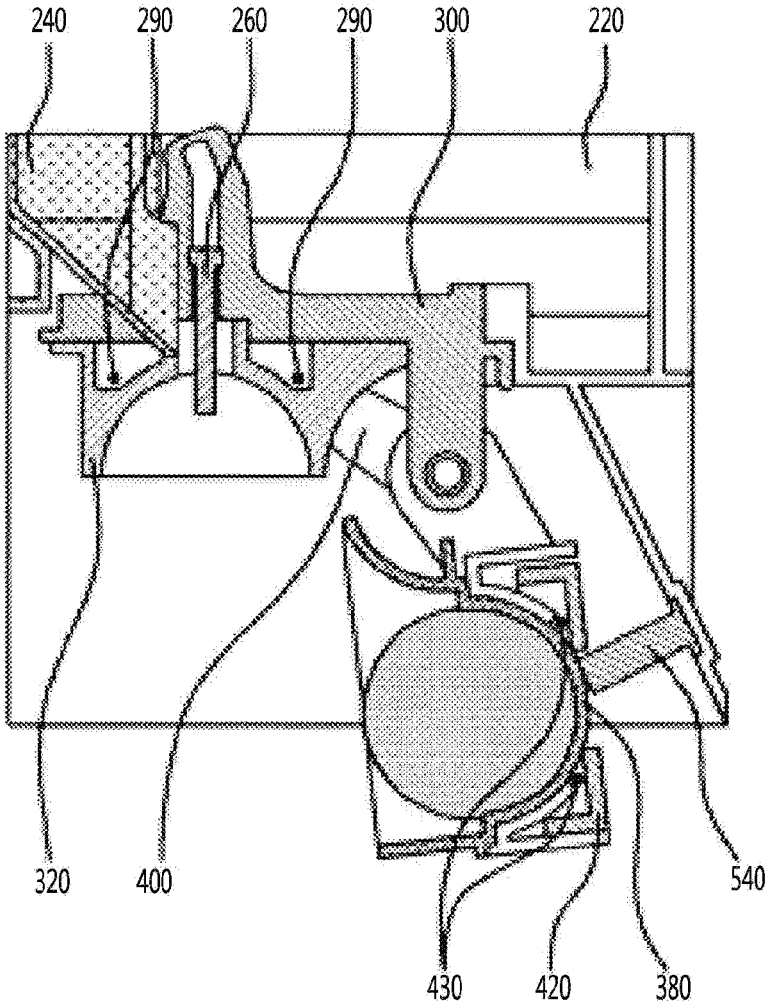

【FIG. 14】
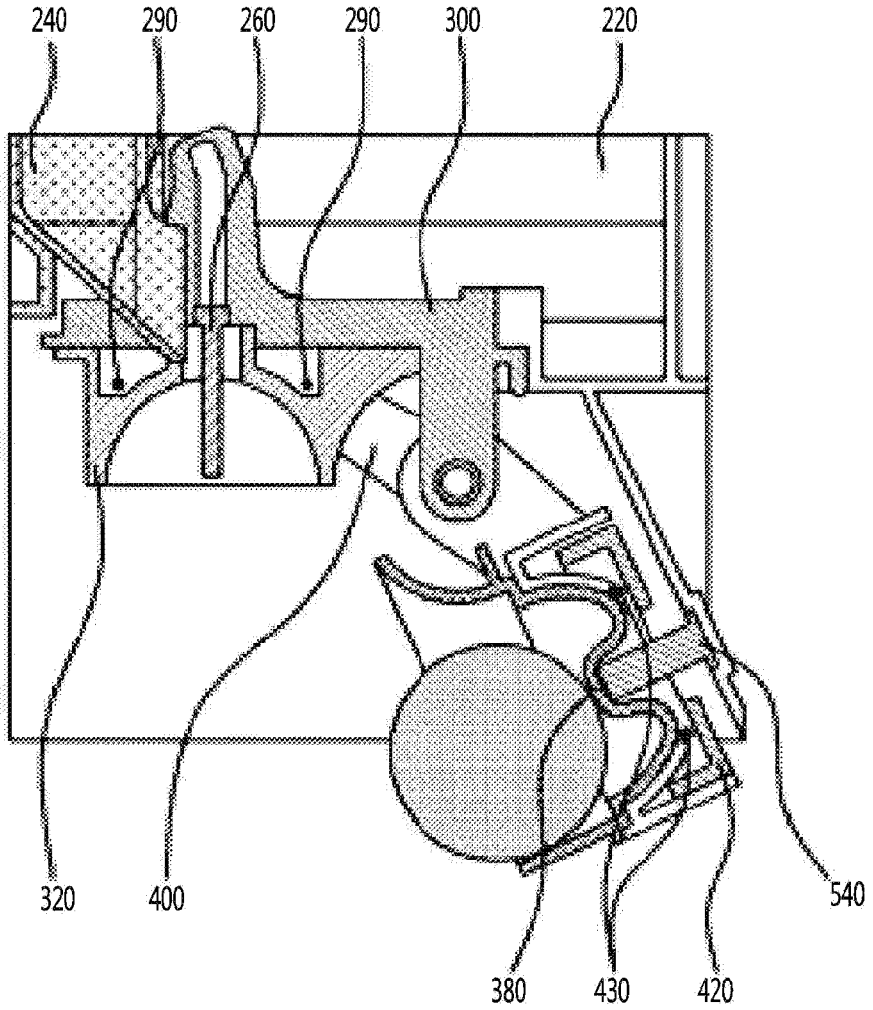

【FIG. 15】
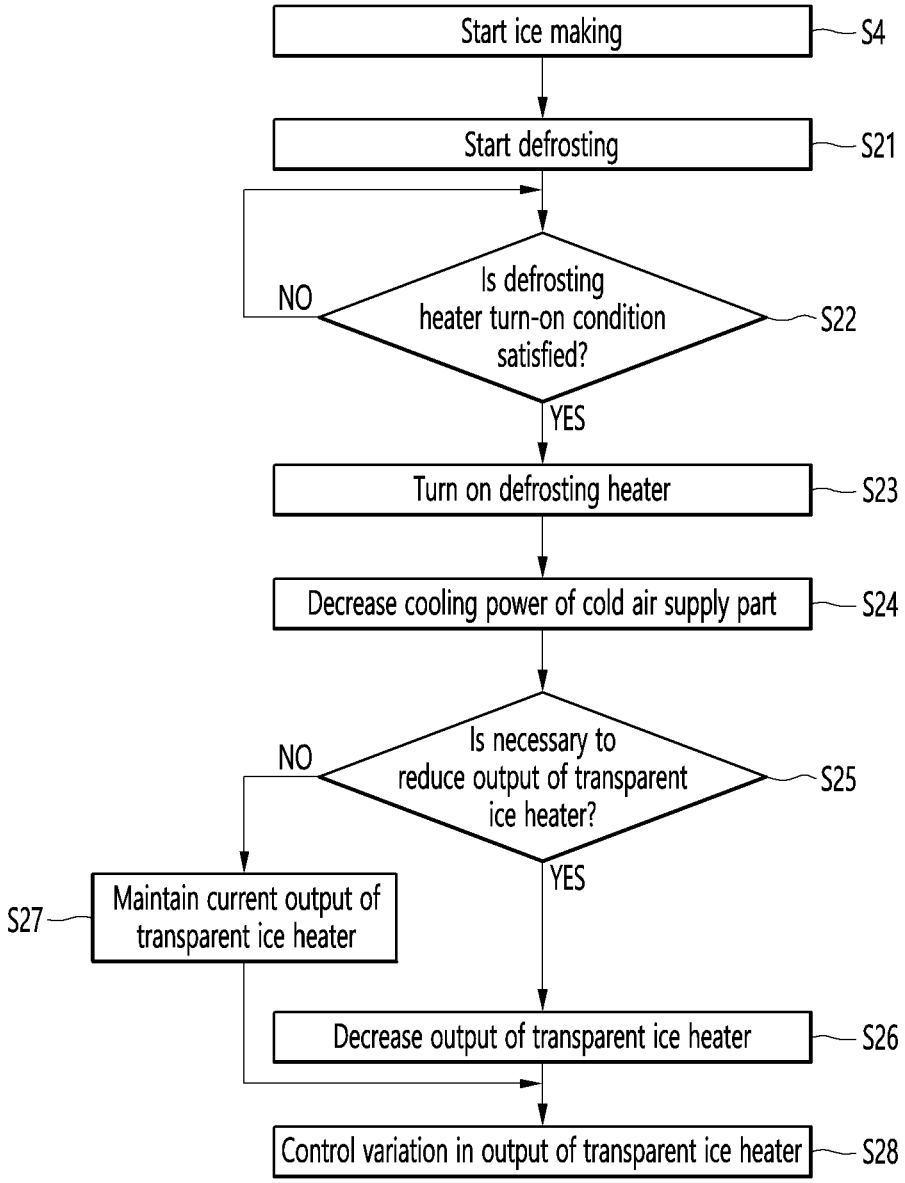

【FIG. 16A】
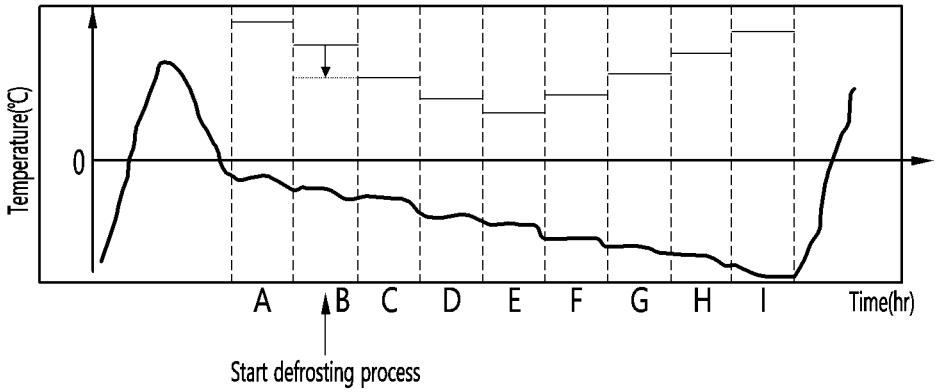
【FIG. 16B】
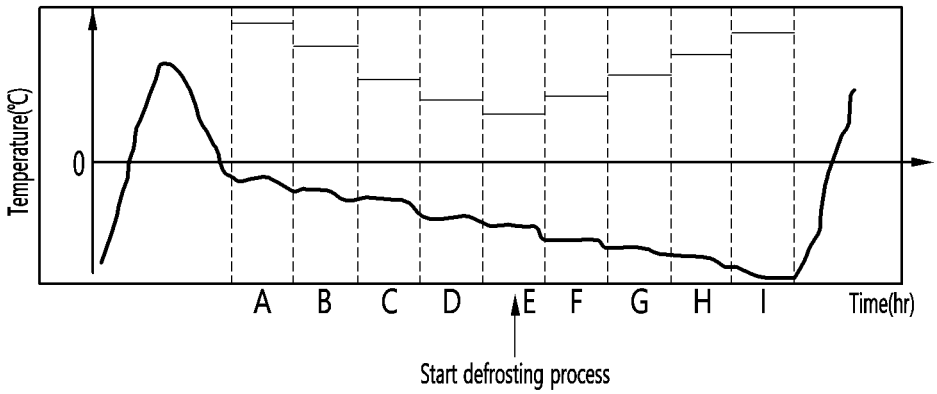
【FIG. 16C】
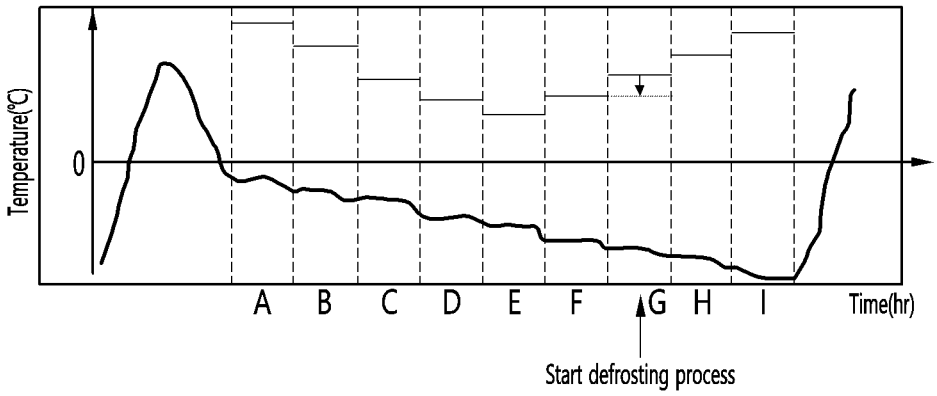

REFRIGERATOR AND CONTROL METHOD THEREFOR

CROSS-REFERENCE TO RELATED PATENT APPLICATIONS

This application is a U.S. National Stage Application under 35 U.S.C. § 371 of PCT Application No. PCT/KR2019/012852, filed Oct. 1, 2019, which claims priority to Korean Patent Application Nos. 10-2018-0117785, 10-2018-0117819, 10-2018-0117821, 10-2018-0117822, all filed Oct. 2, 2018, 10-2018-0142117, filed Nov. 16, 2018, 10-2019-0081702 and 10-2019-0081715, filed Jul. 6, 2019, whose entire disclosures are hereby incorporated by reference.

TECHNICAL FIELD

The present disclosure relates to a refrigerator and a control method therefor.

BACKGROUND ART

In general, refrigerators are home appliances for storing foods at a low temperature in a storage chamber that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker may separate the made ice from the ice tray in a heating manner or twisting manner.

For example, the ice maker through which water is automatically supplied and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of heater increases to suppress an increase in the solidification rate.

However, according to prior art document 2, since the heating amount of the heater is increased simply when the volume of water is reduced, it is difficult to make ice having uniform transparency according to the shape of the ice.

DISCLOSURE

Technical Problem

Embodiments provide a refrigerator capable of making ice having uniform transparency as a whole regardless of shape, and a method for controlling the same.

Embodiments provide a refrigerator capable of making spherical ice and having uniform transparency for each unit height of the spherical ice, and a method for controlling the same.

Embodiments provide a refrigerator capable of making ice having uniform transparency as a whole by varying a heating amount of a transparent ice heater in response to the change in the heat transfer amount between water in an ice making cell and cold air in a storage chamber, and a method for controlling the same.

Embodiments provide a refrigerator in which, if an output of a transparent ice heater needs to be reduced when defrosting is performed in an ice making process, the output of the transparent ice heater is reduced, thereby preventing the transparency of transparent ice from deteriorating during the defrosting process and reducing power consumption of the transparent ice heater, and a method for controlling the same.

Technical Solution

According to one aspect, a refrigerator may include a first tray configured to define a portion of an ice making cell that is a space in which water is phase-changed into ice by cold of a cooler, a second tray configured to define another portion of the ice making cell, a heater disposed adjacent to at least one of the first tray and the second tray, and a controller configured to control the heater.

The controller may turn on the heater, which supplies heat to the ice making cell, in at least partial section while the cooler supplies cold to the ice making cell so that bubbles dissolved in the water within the ice making cell moves from a portion, at which the ice is made, toward the water that is in a liquid state to make transparent ice.

A defrosting process for an evaporator may be performed for defrosting when a defrosting start condition is satisfied in a state in which the heater is turned on. In this case, the amount of cold supply of the cooler in the defrosting process can be reduced more than the amount of cold supply of a cold air supply part before the defrosting start condition is satisfied. The amount of cold supply of the cooler is the amount of cold supplied, and may vary according to, for example, the cooling power of the cold air supply part that supplies cold.

The refrigerator may further include a defrosting heater configured to heat the evaporator, and when the defrosting process starts, the defrosting heater may be turned on.

The heater may also maintain the turned-on state in a state in which the defrosting heater is turned on.

For example, the controller may maintain the output of the heater when the defrosting start condition is satisfied and the output of the heater is less than or equal to a reference value in the ice making process. On the other hand, when the defrosting start condition is satisfied and the output of the heater exceeds the reference value during the ice making process, the controller may control the output of the heater so that the output of the heater after the operation of the defrosting heater is less than the output of the heater before the operation of the defrosting heater.

For another example, when the defrosting heater is turned on during the ice making process, the controller may maintain the output of the heater when the temperature sensed by the temperature sensor is less than the reference value. On the other hand, when the temperature sensed by the temperature sensor is greater than or equal to the reference value, the controller may control the output of the heater so that the output of the heater after the operation of the defrosting heater is less than the output of the heater before the operation of the defrosting heater.

A total time for which the heater operates for ice making when the ice making process starts may be longer than a total time for which the heater operates for ice making when the ice making process is not performed.

According to an embodiment, the controller may perform control so that a pre-defrosting process is performed before the defrosting process.

The amount of cold supply of the cooler in the pre-defrosting process may be increased more than the amount of cold supply of the cooler before the defrosting start condition is satisfied, and the controller may increase the heating amount of the heater in response to the increase in the amount of cold supply of the cooler in the pre-defrosting process.

The controller may perform control so that a post-defrosting process is performed after the defrosting process.

The amount of cold supply of the cooler in the post-defrosting process may be increased more than the amount of cold supply of the cooler before the defrosting start condition is satisfied, and the controller may increase the heating amount of the heater in response to the increase in the amount of cold supply of the cooler in the post-defrosting process.

According to an embodiment, the second tray may contact the first tray in the ice making process and may be spaced apart from the first tray in an ice separation process. The second tray may be connected to a driver to receive power from the driver.

Due to the operation of the driver, the second tray may move from a water supply position to an ice making position. Also, due to the operation of the driver, the second tray may move from the ice making position to an ice separation position. The water supply of the ice making cell may be performed when the second tray moves to the water supply position.

After the water supply is completed, the second tray may be moved to the ice making position. After the second tray moves to the ice making position, the cooler may supply the cold to the ice making cell.

When the ice is completely made in the ice making cell, the second tray move to the ice separation position in a forward direction so as to take out the ice in the ice making cell. After the second tray moves to the ice separation position, the second tray may move to the water supply position in the reverse direction, and the water supply may start again.

According to one aspect, the controller may control one or more of the amount of cold supply of the cooler and the heating amount of the heater to vary according to a mass per unit height of water in the ice making cell, so that the transparency for each unit height of the water in the ice making cell is uniform.

A plurality of sections may be defined based on the unit height of water. A reference output of the heater in each of the plurality of sections may be predetermined.

When the ice making cell has a spherical shape, the controller may perform control so that the output of the heater decreases and then increases during the ice making process.

When the defrosting process starts in the ice making process, the controller may determine whether it is necessary to reduce the output of the heater, and when it is necessary to reduce the output of the heater, the controller may reduce the output of the heater in a current section.

The controller may maintain the output of the heater when the section when the defrosting process starts is an intermediate section in which the output of the heater is minimum among the plurality of sections.

When the section in which the defrosting process starts is a section prior to the intermediate section among the plurality of sections, the controller may reduce the output of the heater in the current section to a reference output corresponding to an immediately next section.

When the section in which the defrosting process starts is a section after the intermediate section among the plurality of sections, the controller may reduce the output of the heater in the current section to a reference output corresponding to an immediately previous section.

When the temperature sensed by the temperature sensor reaches the reference temperature corresponding to the section immediately next to the current section, the controller may operate the heater with the reference output corresponding to the next section.

One of the first tray and the second tray may be made of a non-metal material so as to reduce a heat transfer rate of the heater.

The second tray may be disposed below the first tray. The heater may be disposed adjacent to the second tray so that water starts to freeze from above in the ice making cell. At least the second tray may be made of a non-metal material.

At least one of the first tray and the second tray may be made of a flexible material so that the shape thereof is deformed during the ice separation process and is returned to the original shape.

According to another aspect, a method for controlling a refrigerator relates to a method for controlling a refrigerator that includes a first tray accommodated in a storage chamber, a second tray configured to define an ice making cell together with the first tray, a driver configured to move the second tray, and a transparent ice heater configured to supply heat to at least one of the first tray and the second tray.

The method for controlling the refrigerator may include: performing water supply of the ice making cell when the second tray moves to a water supply position; and performing ice making after the water supply is completed and the second tray moves from the water supply position to an ice making position in a reverse direction.

According to an embodiment, the transparent ice heater may be turned on in at least partial section while the ice making is performed, so that bubbles dissolved in the water within the ice making cell moves from a portion, at which the ice is made, toward the water that is in a liquid state to make transparent ice.

When a defrosting start condition is satisfied during an ice making process, the transparent ice heater may be maintained in a turned-on state and a defrosting heater may be turned on for defrosting.

The output of the transparent ice heater may be maintained when the defrosting start condition is satisfied and the output of the transparent ice heater is less than or equal to a reference value. On the other hand, when the output of the transparent ice heater exceeds the reference value, the output of the transparent ice heater may be controlled so that the output of the transparent ice heater after the operation of the defrosting heater is less than the output of the transparent ice heater before the operation of the defrosting heater.

Alternatively, when the defrosting heater is turned on, the output of the transparent ice heater may be maintained when the temperature sensed by the temperature sensor configured to sense a temperature of the ice making cell is less than a reference value. On the other hand, when the temperature sensed by the temperature sensor is greater than or equal to the reference value, the output of the transparent ice heater may be controlled so that the output of the transparent ice heater after the operation of the defrosting heater is less than the output of the transparent ice heater before the operation of the defrosting heater.

According to an embodiment, the method for controlling the refrigerator may further include: determining whether the ice making is completed; and when the ice making is completed, moving the second tray from the ice making position to an ice separation position in a forward direction.

According to another aspect, a method for controlling a refrigerator relates to a method for controlling a refrigerator that includes a first tray and a second tray configured to define a spherical ice making cell.

The method for controlling the refrigerator may include: after the water supply of the ice making cell is completed, supplying cold from a cooler to an ice making cell to start ice making; turning on a transparent ice heater for supplying heat to the ice making cell after the ice making starts; determining whether a defrosting start condition is satisfied during an ice making process; and when it is determined that the defrosting start condition is satisfied, reducing the heating amount of the cooler and turning on the defrosting heater.

According to an embodiment, the defrosting heater may maintain the turned-on state in a state in which the defrosting heater is turned on.

During the ice making process, the output of the transparent ice heater may be controlled to vary according to the mass per unit height of water in the ice making cell, and a plurality of sections may be defined based on the unit height of the water. A reference output of the transparent ice heater in each of the plurality of sections may be predetermined.

When the defrosting start condition is satisfied in the ice making process, the controller determines whether it is necessary to reduce the output of the transparent ice heater.

When it is necessary to reduce the output of the transparent ice heater, the controller may reduce the output of the transparent ice heater in a current section. On the other hand, when it is unnecessary to reduce the output of the transparent ice heater, the controller may maintain the output of the transparent ice heater in a current section.

According to further another aspect, a refrigerator may include a controller that, when a first transparent ice operation and a second transparent ice operation for defrosting response collide, preferentially performs the second transparent ice operation and stops the first transparent ice operation.

The refrigerator may include: a storage chamber configured to store foods; a door configured to open and close the storage chamber; a cold air supply part configured to supply cold air to the storage chamber; a defrosting heater configured to heat an evaporator for generating cold air; a first temperature sensor configured to sense a temperature within the storage chamber; a first tray disposed in the storage chamber and configured to define a portion of an ice making cell that is a space in which water is phase-changed into ice by the cold air; a second tray configured to define another portion of the ice making cell, the second tray being connected to a driver to contact the first tray during an ice making process and to be spaced apart from the first tray during an ice separation process; a water supply part configured to supply water into the ice making cell; a second temperature sensor configured to sense a temperature of the water or the ice within the ice making cell; and a defrosting heater disposed adjacent to at least one of the first tray or the second tray.

The first transparent ice operation may include performing control so that, after the water supply of the ice making cell is completed, the controller controls the cold air supply part to supply cold air to the ice making cell, the ice making heater is turned on in at least some sections while the cold air supply part supplies cold air, and the turned-on ice making heater is variable in a predetermined reference heating amount in each of a plurality of pre-divided sections.

After the defrosting start condition is satisfied in the second transparent ice operation, a defrosting process may be performed so that the controller reduces the cooling power of the cold air supply part more than the cooling power of the cold air supply part before the defrosting start condition is satisfied, and the defrosting heater may be turned on in at least some sections in which the cooling power is reduced. When the start condition of the defrosting response operation for the ice making heater is satisfied, the deterioration of the ice making efficiency may be reduced by the lowering of the ice making rate due to the heat load applied during the defrosting process, and in order to maintain the ice making rate within a predetermined range and uniformly maintain the transparency of ice, the controller may reduce the heating amount of the ice making heater compared to the heating amount of the ice making heater during the first transparent ice operation.

A case in which the start condition of the defrosting response operation is satisfied may include at least one of a case in which the second set time elapses after the defrosting process is performed, a case in which the temperature detected by the second temperature sensor after the defrosting process is performed is equal to or higher than a second set temperature, a case in which, after the defrosting process is performed, the temperature is higher than the temperature detected by the second temperature sensor by the second set value or more, a case in which the amount of change in temperature detected by the second temperature sensor per unit time after the defrosting process is performed is greater than 0, a case in which, after the defrosting process is performed, the heating amount of the ice making heater is greater than a reference value, and a case in which the defrosting process operation starts.

A case in which the end condition of the defrosting response operation is satisfied may include at least one of a case in which the B set time elapses after the defrosting response operation is performed, a case in which the temperature detected by the second temperature sensor after the defrosting response operation is performed is equal to or lower than the B set temperature, a case in which, after the defrosting response operation starts, the temperature is lower than the temperature detected by the second temperature sensor by the B set value or more, a case in which the amount of change in temperature detected by the second temperature sensor per unit time after the defrosting response operation starts is less than 0, and a case in which the defrosting process operation is ended.

In the second transparent ice operation, before the defrosting process, the controller may perform a pre-defrosting process of increasing the cooling power of the cold air supply part more than the cooling power of the cold air supply part before the defrosting start condition is satisfied, and the controller may perform control to increase the heating amount of the ice making heater in response to the increase in cooling power of the cold air supply part in the pre-defrosting process.

After the defrosting process, the controller may perform a post-defrosting process of increasing the cooling power of the cold air supply part more than the cooling power of the cold air supply part before the defrosting start condition is satisfied. In the post-defrosting process, the heating amount of the ice making heater may be increased in response to the increase in cooling power of the cold air supply part.

The controller may control the first transparent ice operation to resume after the end condition of the post-defrosting process operation is satisfied.

The plurality of pre-divided sections may include at least one of a case in which the sections are classified based on the unit height of the water to be iced, a case in which the sections are divided based on the elapsed time after the second tray moves to the ice making position, and a case in which the sections are divided based on the temperature detected by the second temperature sensor after the second tray moves to the ice making position.

When the ice making cell has a spherical shape, the controller may perform control so that the heating amount of the ice making heater decreases and then increases during the ice making process.

According to still another aspect, a refrigerator includes: a storage chamber configured to store food; a cooler configured to supply cold into the storage chamber; a first tray configured to define a portion of an ice making cell that is a space in which water is phase-changed into ice by the cold; a second tray configured to define another portion of the ice making cell; a heater disposed adjacent to at least one of the first tray or the second tray; and a controller configured to control the heater, wherein, when a defrosting start condition is satisfied in the ice making process, the controller performs a defrosting process and reduces the amount of cold supply of the cooler.

When the defrosting start condition is satisfied during the ice making process, the controller may maintain or decrease the heating amount supplied by the heater.

The controller may control the heating amount of the heater to vary in the plurality of preset sections during the ice making process.

The controller may perform control to maintain the heating amount of the heater when the section when the defrosting process starts is a section in which the initial heating amount of the heater is minimum among the plurality of sections.

When a heating amount of the heater in a next section is less than the heating amount of the heater in a section when the defrosting process starts, the controller may control the heating amount of the heater to be changed to the heating amount in the next section.

When a heating amount of the heater in a previous section is less than the heating amount of the heater in a section when the defrosting process starts, the controller may control the heating amount of the heater to be changed to the heating amount in the previous section.

When the defrosting process is completed, the controller may control the heating amount of the heater to be changed to the heating amount of the heater in a section when the defrosting process starts.

After completion of the defrosting process, the controller may perform control so that the heater is turned on for the remaining time of the heater in a section when the defrosting process starts.

After the heater is turned on for the remaining time, the controller may perform control so that the heating amount of the heater is changed to the heating amount in the next section.

The controller may control the heater so that when a heat transfer amount between the cold within the storage chamber and the water of the ice making cell increases, the heating amount of the heater increases, and when the heat transfer amount between the cold within the storage chamber and the water of the ice making cell decreases, the heating amount of the heater decreases so as to maintain an ice making rate of the water within the ice making cell within a predetermined range that is less than an ice making rate when the ice making is performed in a state in which the heater is turned off.

The controller may control the heater to be turned off when the temperature value measured by the temperature sensor, which measures the temperature of water or ice in the ice making cell, is greater than or equal to a reference temperature value while the defrosting process is being performed.

The controller may control the heater to be turned on when the value measured by the temperature sensor is less than the reference temperature value.

When the value measured by the temperature sensor is greater than or equal to the reference temperature value, the controller may control the heater to operate with a heating amount before the heater is turned off.

After the defrosting process is completed and the heater is turned on for the remaining time, the controller may perform control so that the heating amount of the heater is changed to the heating amount of the heater in the next section.

The controller may control the heater to be turned off when it is determined that ice is not made in the ice making cell while the defrosting process is being performed.

The controller may control the heater to be turned on when it is determined that ice is made in the ice making cell while the defrosting process is being performed.

When it is determined that ice is made in the ice making cell while the defrosting process is being performed, the controller may control the heater to operate with the heating amount before the heater is turned off.

After the defrosting process is completed and the heater is turned on for the remaining time, the controller may perform control so that the heating amount of the heater is changed to the heating amount of the heater in the next section.

In the ice making process, a total time for which the heater operates for ice making when the defrosting process starts may be longer than a total time for which the heater operates for ice making when the defrosting process is not performed.

The controller may control the heating amount of the heater to vary in the plurality of preset sections during the ice making process. The controller may control the heater to enter an additional heating process after the heater is driven with a heating amount set in a last section of the plurality of sections.

The controller may control the period of the additional heating process to become longer as the time having elapsed until the start of the current defrosting process from the end of the previous defrosting process is longer.

Advantageous Effects

According to the embodiments, since the heater is turned on in at least a portion of the sections while the cooler supplies cold, the ice making rate may decrease by the heat of the heater so that the bubbles dissolved in the water inside the ice making cell move toward the liquid water from the portion at which the ice is made, thereby making the transparent ice.

In particular, according to the embodiments, one or more of the amount of cold supply of a cooler and the heating amount of heater may be controlled to vary according to the mass per unit height of water in a ice making cell to make ice having uniform transparency as a whole regardless of the shape of the ice making cell.

In addition, even if defrosting is introduced during an ice making process, a transparent ice heater maintains an on state, thereby preventing ice from being made in a portion adjacent to the transparent ice heater in a defrosting process and preventing the transparency of transparent ice from deteriorating.

In addition, in an ice making process, the output is reduced when it is necessary to reduce the output of the transparent ice heater after the defrosting is introduced, thereby reducing power consumption of the transparent ice heater.

DESCRIPTION OF DRAWINGS

FIGS. 1A and 1B are front views of a refrigerator according to an embodiment.

FIG. 2 is a perspective view of an ice maker according to an embodiment.

FIG. 3 is a perspective view illustrating a state in which a bracket is removed from the ice maker of FIG. 2.

FIG. 4 is an exploded perspective view of the ice maker according to an embodiment.

FIG. 5 is a cross-sectional view taken along line A-A of FIG. 3 for showing a second temperature sensor installed in an ice maker according to an embodiment.

FIG. 6 is a longitudinal cross-sectional view of an ice maker when a second tray is disposed at a water supply position according to an embodiment.

FIG. 7 is a block diagram illustrating a control of a refrigerator according to an embodiment.

FIG. 8 is a flowchart for explaining a process of making ice in the ice maker according to an embodiment.

FIGS. 9A and 9B are views for explaining a height reference depending on a relative position of the transparent heater with respect to the ice making cell.

FIGS. 10A and 10B are views for explaining an output of the transparent heater per unit height of water within the ice making cell.

FIG. 11 is a view illustrating a state in which supply of water is completed at a water supply position.

FIG. 12 is a view illustrating a state in which ice is made at an ice making position.

FIG. 13 is a view illustrating a state in which a second tray is separated from a first tray during an ice separation process.

FIG. 14 is a view illustrating a state in which a second tray is moved to an ice separation position during an ice separation process.

FIG. 15 is a flowchart for explaining a method for controlling a transparent ice heater when a defrosting process of an evaporator is started in an ice making process.

FIGS. 16A to 16C are views illustrating a change in output of a transparent ice heater for each unit height of water and a change in temperature detected by a second temperature sensor during an ice making process.

MODE FOR INVENTION

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", "coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller. The refrigerator may further include a temperature sensor detecting a temperature of water or ice of the ice making cell. The refrigerator may further include a heater disposed adjacent to the tray assembly. The refrigerator may further include a driver to move the tray assembly. The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The controller may control the cooler so that cold is supplied to the ice making cell after moving the tray assembly to an ice making position. The controller may control the second tray assembly so that the second tray assembly moves to an ice separation position in a forward direction so as to take out the ice in the ice making cell when the ice is completely made in the ice making cell. The controller may control the tray assembly so that the supply of the water supply part after the second tray assembly moves to the water supply position in the reverse direction when the ice is completely separated. The controller may control the tray assembly so as to move to the ice making position after the water supply is completed.

According to an embodiment, the storage chamber may be defined as a space that is controlled to a predetermined temperature by the cooler. An outer case may be defined as a wall that divides the storage chamber and an external space of the storage chamber (i.e., an external space of the refrigerator). An insulation material may be disposed between the outer case and the storage chamber. An inner case may be disposed between the insulation material and the storage chamber.

According to an embodiment, the ice making cell may be disposed in the storage chamber and may be defined as a space in which water is phase-changed into ice. A circumference of the ice making cell refers to an outer surface of the ice making cell irrespective of the shape of the ice making cell. In another aspect, an outer circumferential surface of the ice making cell may refer to an inner surface of the wall defining the ice making cell. A center of the ice making cell refers to a center of gravity or volume of the ice making cell. The center may pass through a symmetry line of the ice making cell.

According to an embodiment, the tray may be defined as a wall partitioning the ice making cell from the inside of the storage chamber. The tray may be defined as a wall defining at least a portion of the ice making cell. The tray may be configured to surround the whole or a portion of the ice making cell. The tray may include a first portion that defines at least a portion of the ice making cell and a second portion extending from a predetermined point of the first portion. The tray may be provided in plurality. The plurality of trays may contact each other. For example, the tray disposed at the lower portion may include a plurality of trays. The tray disposed at the upper portion may include a plurality of trays. The refrigerator may include at least one tray disposed under the ice making cell. The refrigerator may further include a tray disposed above the ice making cell. The first portion and the second portion may have a structure inconsideration of a degree of heat transfer of the tray, a degree of cold transfer of the tray, a degree of deformation resistance of the tray, a recovery degree of the tray, a degree of supercooling of the tray, a degree of attachment between the tray and ice solidified in the tray, and coupling force between one tray and the other tray of the plurality of trays.

According to an embodiment, the tray case may be disposed between the tray and the storage chamber. That is, the tray case may be disposed so that at least a portion thereof surrounds the tray. The tray case may be provided in plurality. The plurality of tray cases may contact each other. The tray case may contact the tray to support at least a portion of the tray. The tray case may be configured to connect components except for the tray (e.g., a heater, a sensor, a power transmission member, etc.). The tray case may be directly coupled to the component or coupled to the component via a medium therebetween. The tray case may be directly coupled to the component or coupled to the component via a medium therebetween. For example, if the wall defining the ice making cell is provided as a thin film, and a structure surrounding the thin film is provided, the thin film may be defined as a tray, and the structure may be defined as a tray case. For another example, if a portion of the wall defining the ice making cell is provided as a thin film, and a structure includes a first portion defining the other portion of the wall defining the ice making cell and a second part surrounding the thin film, the thin film and the first portion of the structure are defined as trays, and the second portion of the structure is defined as a tray case.

According to an embodiment, the tray assembly may be defined to include at least the tray. According to an embodiment, the tray assembly may further include the tray case.

According to an embodiment, the refrigerator may include at least one tray assembly connected to the driver to move. The driver is configured to move the tray assembly in at least one axial direction of the X, Y, or Z axis or to rotate about the axis of at least one of the X, Y, or Z axis. The embodiment may include a refrigerator having the remaining configuration except for the driver and the power transmission member connecting the driver to the tray assembly in the contents described in the detailed description. According to an embodiment, the tray assembly may move in a first direction.

According to an embodiment, the cooler may be defined as a part configured to cool the storage chamber including at least one of an evaporator or a thermoelectric element.

According to an embodiment, the refrigerator may include at least one tray assembly in which the heater is disposed. The heater may be disposed in the vicinity of the tray assembly to heat the ice making cell defined by the tray assembly in which the heater is disposed. The heater may include a heater to be turned on in at least partial section while the cooler supplies cold so that bubbles dissolved in the water within the ice making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to an embodiment, the tray assembly may include a first region and a second region, which define an outer circumferential surface of the ice making cell. The tray assembly may include a first portion that defines at least a portion of the ice making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice making cell defined by the tray assembly. The second region may be an upper portion of an ice making cell defined by the tray assembly. The refrigerator may include an additional tray assembly. One of the first and second regions may include a region contacting the additional tray assembly. When the additional tray assembly is disposed in a lower portion of the first region, the additional tray assembly may contact the lower portion of the first region. When the additional tray assembly is disposed in an upper portion of the second region, the additional tray assembly and the upper portion of the second region may contact each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice making cell defined by the first and second tray assemblies. At least a portion of the second tray assembly may be disposed above the ice making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold to the ice making cell than the first region. To allow the cooler to supply the cold through the through-hole, an additional through-hole may be defined in another component. The second region may be a region closer to the additional through-hole than the first region. The heater may be a transparent ice heater. The heat insulation degree of the second region with respect to the cold may be less than that of the first region.

The heater may be disposed in one of the first and second tray assemblies of the refrigerator. For example, when the heater is not disposed on the other one, the controller may control the heater to be turned on in at least a sections of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The embodiment may include a refrigerator having a configuration excluding the transparent ice heater in the contents described in the detailed description.

The embodiment may include a pusher including a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a penetrating type pusher, a non-penetrating type pusher, a movable pusher, or a fixed pusher according to a view point.

The through-hole through which the pusher moves may be defined in the tray assembly, and the pusher may be configured to directly press the ice in the tray assembly. The pusher may be defined as a penetrating type pusher.

The tray assembly may be provided with a pressing part to be pressed by the pusher, the pusher may be configured to apply a pressure to one surface of the tray assembly. The pusher may be defined as a non-penetrating type pusher.

The controller may control the pusher to move so that the first edge of the pusher is disposed between a first point outside the ice making cell and a second point inside the ice making cell. The pusher may be defined as a movable pusher. The pusher may be connected to a driver, the rotation shaft of the driver, or the tray assembly that is connected to the driver and is movable.

The controller may control the pusher to move at least one of the tray assemblies so that the first edge of the pusher is disposed between the first point outside the ice making cell and the second point inside the ice making cell. The controller may control at least one of the tray assemblies to move to the pusher. Alternatively, the controller may control a relative position of the pusher and the tray assembly so that the pusher further presses the pressing part after contacting the pressing part at the first point outside the ice making cell. The pusher may be coupled to a fixed end. The pusher may be defined as a fixed pusher.

According to an embodiment, the ice making cell may be cooled by the cooler cooling the storage chamber. For example, the storage chamber in which the ice making cell is disposed may be a freezing compartment which is controlled at a temperature lower than 0° C., and the ice making cell may be cooled by the cooler cooling the freezing compartment.

The freezing compartment may be divided into a plurality of regions, and the ice making cell may be disposed in one region of the plurality of regions.

According to an embodiment, the ice making cell may be cooled by a cooler other than the cooler cooling the storage chamber. For example, the storage chamber in which the ice making cell is disposed is a refrigerating compartment which is controlled to a temperature higher than 0° C., and the ice making cell may be cooled by a cooler other than the cooler cooling the refrigerating compartment. That is, the refrigerator may include a refrigerating compartment and a freezing compartment, the ice making cell may be disposed inside the refrigerating compartment, and the ice maker cell may be cooled by the cooler that cools the freezing compartment.

The ice making cell may be disposed in a door that opens and closes the storage chamber.

According to an embodiment, the ice making cell is not disposed inside the storage chamber and may be cooled by the cooler. For example, the entire storage chamber defined inside the outer case may be the ice making cell.

According to an embodiment, a degree of heat transfer indicates a degree of heat transfer from a high-temperature object to a low-temperature object and is defined as a value determined by a shape including a thickness of the object, a material of the object, and the like. In terms of the material of the object, a high degree of the heat transfer of the object may represent that thermal conductivity of the object is high. The thermal conductivity may be a unique material property of the object. Even when the material of the object is the same, the degree of heat transfer may vary depending on the shape of the object.

The degree of heat transfer may vary depending on the shape of the object. The degree of heat transfer from a point A to a point B may be influenced by a length of a path through which heat is transferred from the point A to the point B (hereinafter, referred to as a "heat transfer path"). The more the heat transfer path from the point A to the point B increases, the more the degree of heat transfer from the point A to the point B may decrease. The more the heat transfer path from the point A to the point B, the more the degree of heat transfer from the point A to the point B may increase.

The degree of heat transfer from the point A to the point B may be influenced by a thickness of the path through which heat is transferred from the point A to the point B. The more the thickness in a path direction in which heat is transferred from the point A to the point B decreases, the more the degree of heat transfer from the point A to the point B may decrease. The greater the thickness in the path direction from which the heat from point A to point B is transferred, the more the degree of heat transfer from point A to point B.

According to an embodiment, a degree of cold transfer indicates a degree of heat transfer from a low-temperature object to a high-temperature object and is defined as a value determined by a shape including a thickness of the object, a material of the object, and the like. The degree of cold transfer is a term defined in consideration of a direction in which cold air flows and may be regarded as the same concept as the degree of heat transfer. The same concept as the degree of heat transfer will be omitted.

According to an embodiment, a degree of supercooling is a degree of supercooling of a liquid and may be defined as a value determined by a material of the liquid, a material or shape of a container containing the liquid, an external factors applied to the liquid during a solidification process of the liquid, and the like. An increase in frequency at which the liquid is supercooled may be seen as an increase in degree of the supercooling. The lowering of the temperature at which the liquid is maintained in the supercooled state may be seen as an increase in degree of the supercooling. Here, the supercooling refers to a state in which the liquid exists in the liquid phase without solidification even at a temperature below a freezing point of the liquid. The supercooled liquid has a characteristic in which the solidification rapidly occurs from a time point at which the supercooling is terminated. If it is desired to maintain a rate at which the liquid is solidified, it is advantageous to be designed so that the supercooling phenomenon is reduced.

According to an embodiment, a degree of deformation resistance represents a degree to which an object resists deformation due to external force applied to the object and is a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling.

In terms of the material of the object, a high degree of the deformation resistance of the object may represent that rigidity of the object is high. The thermal conductivity may be a unique material property of the object. Even when the material of the object is the same, the degree of deformation resistance may vary depending on the shape of the object. The degree of deformation resistance may be affected by a deformation resistance reinforcement part extending in a direction in which the external force is applied. The more the rigidity of the deformation resistant resistance reinforcement part increases, the more the degree of deformation resistance may increase. The more the height of the extending deformation resistance reinforcement part increase, the more the degree of deformation resistance may increase.

According to an embodiment, a degree of restoration indicates a degree to which an object deformed by the external force is restored to a shape of the object before the external force is applied after the external force is removed and is defined as a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling force.

In view of the material of the object, a high degree of the restoration of the object may represent that an elastic modulus of the object is high. The elastic modulus may be a material property unique to the object. Even when the material of the object is the same, the degree of restoration may vary depending on the shape of the object. The degree of restoration may be affected by an elastic resistance reinforcement part extending in a direction in which the external force is applied. The more the elastic modulus of the elastic resistance reinforcement part increases, the more the degree of restoration may increase.

According to an embodiment, the coupling force represents a degree of coupling between the plurality of tray assemblies and is defined as a value determined by a shape including a thickness of the tray assembly, a material of the tray assembly, magnitude of the force that couples the trays to each other, and the like.

According to an embodiment, a degree of attachment indicates a degree to which the ice and the container are attached to each other in a process of making ice from water contained in the container and is defined as a value determined by a shape including a thickness of the container, a material of the container, a time elapsed after the ice is made in the container, and the like.

The refrigerator according to an embodiment includes a first tray assembly defining a portion of an ice making cell that is a space in which water is phase-changed into ice by cold, a second tray assembly defining the other portion of the ice making cell, a cooler supplying cold to the ice making cell, a water supply part supplying water to the ice making cell, and a controller. The refrigerator may further include a storage chamber in addition to the ice making cell. The storage chamber may include a space for storing food. The ice making cell may be disposed in the storage chamber. The refrigerator may further include a first temperature sensor sensing a temperature in the storage chamber. The refrigerator may further include a second temperature sensor sensing a temperature of water or ice of the ice making cell. The second tray assembly may contact the first tray assembly in the ice making process and may be connected to the driver to be spaced apart from the first tray assembly in the ice making process. The refrigerator may further include a heater disposed adjacent to at least one of the first tray assembly or the second tray assembly.

The controller may control at least one of the heater or the driver. The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water supply part after the second tray assembly moves to the water supply position in the reverse direction when the ice is completely separated.

Transparent ice will be described. Bubbles are dissolved in water, and the ice solidified with the bubbles may have low transparency due to the bubbles. Therefore, in the process of water solidification, when the bubble is guided to move from a freezing portion in the ice making cell to another portion that is not yet frozen, the transparency of the ice may increase.

A through-hole defined in the tray assembly may affect the making of the transparent ice. The through-hole defined in one side of the tray assembly may affect the making of the transparent ice. In the process of making ice, if the bubbles move to the outside of the ice making cell from the frozen portion of the ice making cell, the transparency of the ice may increase. The through-hole may be defined in one side of the tray assembly to guide the bubbles so as to move out of the ice making cell. Since the bubbles have lower density than the liquid, the through-hole (hereinafter, referred to as an "air exhaust hole") for guiding the bubbles to escape to the outside of the ice making cell may be defined in the upper portion of the tray assembly.

The position of the cooler and the heater may affect the making of the transparent ice. The position of the cooler and the heater may affect an ice making direction, which is a direction in which ice is made inside the ice making cell.

In the ice making process, when bubbles move or are collected from a region in which water is first solidified in the ice making cell to another predetermined region in a liquid state, the transparency of the made ice may increase. The direction in which the bubbles move or are collected may be similar to the ice making direction. The predetermined region may be a region in which water is to be solidified lately in the ice making cell.

The predetermined region may be a region in which the cold supplied by the cooler reaches the ice making cell late. For example, in the ice making process, the through-hole through which the cooler supplies the cold to the ice making cell may be defined closer to the upper portion than the lower part of the ice making cell so as to move or collect the bubbles to the lower portion of the ice making cell. For another example, a heat absorbing part of the cooler (that is, a refrigerant pipe of the evaporator or a heat absorbing part of the thermoelectric element) may be disposed closer to the upper portion than the lower portion of the ice making cell. According to an embodiment, the upper and lower portions of the ice making cell may be defined as an upper region and a lower region based on a height of the ice making cell.

The predetermined region may be a region in which the heater is disposed. For example, in the ice making process, the heater may be disposed closer to the lower portion than the upper portion of the ice making cell so as to move or collect the bubbles in the water to the lower portion of the ice making cell.

The predetermined region may be a region closer to an outer circumferential surface of the ice making cell than to a center of the ice making cell. However, the vicinity of the center is not excluded. If the predetermined region is near the center of the ice making cell, an opaque portion due to the bubbles moved or collected near the center may be easily visible to the user, and the opaque portion may remain until most of the ice until the ice is melted. Also, it may be difficult to arrange the heater inside the ice making cell containing water. In contrast, when the predetermined region is defined in or near the outer circumferential surface of the ice making cell, water may be solidified from one side of the outer circumferential surface of the ice making cell toward the other side of the outer circumferential surface of the ice making cell, thereby solving the above limitation. The transparent ice heater may be disposed on or near the outer circumferential surface of the ice making cell. The heater may be disposed at or near the tray assembly.

The predetermined region may be a position closer to the lower portion of the ice making cell than the upper portion of the ice making cell. However, the upper portion is also not excluded. In the ice making process, since liquid water having greater density than ice drops, it may be advantageous that the predetermined region is defined in the lower portion of the ice making cell.

At least one of the degree of deformation resistance, the degree of restoration, and the coupling force between the plurality of tray assemblies may affect the making of the transparent ice. At least one of the degree of deformation resistance, the degree of restoration, and the coupling force between the plurality of tray assemblies may affect the ice making direction that is a direction in which ice is made in the ice making cell. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

To make the transparent ice, it may be advantageous for the refrigerator to be configured so that the direction in which ice is made in the ice making cell is constant. This is because the more the ice making direction is constant, the more the bubbles in the water are moved or collected in a predetermined region within the ice making cell. It may be advantageous for the deformation of the portion to be greater than the deformation of the other portion so as to induce the ice to be made in the direction of the other portion in a portion of the tray assembly. The ice tends to be grown as the ice is expanded toward a potion at which the degree of deformation resistance is low. To start the ice making again after removing the made ice, the deformed portion has to be restored again to make ice having the same shape repeatedly. Therefore, it may be advantageous that the portion having the low degree of the deformation resistance has a high degree of the restoration than the portion having a high degree of the deformation resistance.

The degree of deformation resistance of the tray with respect to the external force may be less than that of the tray case with respect to the external force, or the rigidity of the tray may be less than that of the tray case. The tray assembly allows the tray to be deformed by the external force, while the tray case surrounding the tray is configured to reduce the deformation. For example, the tray assembly may be configured so that at least a portion of the tray is surrounded by the tray case. In this case, when a pressure is applied to the tray assembly while the water inside the ice making cell is solidified and expanded, at least a portion of the tray may be allowed to be deformed, and the other part of the tray may be supported by the tray case to restrict the deformation. In addition, when the external force is removed, the degree of restoration of the tray may be greater than that of the tray case, or the elastic modulus of the tray may be greater than that of the tray case. Such a configuration may be configured so that the deformed tray is easily restored.

The degree of deformation resistance of the tray with respect to the external force may be greater than that of the gasket of the refrigerator with respect to the external force, or the rigidity of the tray may be greater than that of the gasket. When the degree of deformation resistance of the tray is low, there may be a limitation that the tray is excessively deformed as the water in the ice making cell defined by the tray is solidified and expanded. Such a deformation of the tray may make it difficult to make the desired type of ice. In addition, the degree of restoration of the tray when the external force is removed may be configured to be less than that of the refrigerator gasket with respect to the external force, or the elastic modulus of the tray is less than that of the gasket.

The deformation resistance of the tray case with respect to the external force may be less than that of the refrigerator case with respect to the external force, or the rigidity of the tray case may be less than that of the refrigerator case. In general, the case of the refrigerator may be made of a metal material including steel. In addition, when the external force is removed, the degree of restoration of the tray case may be greater than that of the refrigerator case with respect to the external force, or the elastic modulus of the tray case is greater than that of the refrigerator case.

The relationship between the transparent ice and the degree of deformation resistance is as follows.

The second region may have different degree of deformation resistance in a direction along the outer circumferential surface of the ice making cell. The degree of deformation resistance of one portion of the second region may be greater than that of the other portion of the second region. Such a configuration may be assisted to induce ice to be made in a direction from the ice making cell defined by the second region to the ice making cell defined by the first region.

The first and second regions defined to contact each other may have different degree of deformation resistances in the direction along the outer circumferential surface of the ice making cell. The degree of deformation resistance of one portion of the second region may be greater than that of one portion of the first region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in the other direction of the second region or in one direction of the first region. The degree of deformation resistance may be a degree that resists to deformation due to the external force. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the second region may be thicker than the other of the second region or thicker than one portion of the first region. One portion of the second region may be a portion at which the tray case is not surrounded. The other portion of the second region may be a portion surrounded by the tray case. One portion of the first region may be a portion at which the tray case is not surrounded. One portion of the second region may be a portion defining the uppermost portion of the ice making cell in the second region. The second region may include a tray and a tray case locally surrounding the tray. As described above, when at least a portion of the second region is thicker than the other part, the degree of deformation resistance of the second region may be improved with respect to an external force. A minimum value of the thickness of one portion of the second region may be greater than that of the thickness of the other portion of the second region or greater than that of one portion of the first region. A maximum value of the thickness of one portion of the second region may be greater than that of the thickness of the other portion of the second region or greater than that of one portion of the first region. When the through-hole is defined in the region, the minimum value represents the minimum value in the remaining regions except for the portion in which the through-hole is defined. An average value of the thickness of one portion of the second region may be greater than that of the thickness of the other portion of the second region or greater than that of one portion of the first region. The uniformity of the thickness of one portion of the second region may be less than that of the thickness of the other portion of the second region or less than that of one of the thickness of the first region.

For another example, one portion of the second region may include a first surface defining a portion of the ice making cell and a deformation resistance reinforcement part extending from the first surface in a vertical direction away from the ice making cell defined by the other of the second region. One portion of the second region may include a first surface defining a portion of the ice making cell and a deformation resistance reinforcement part extending from the first surface in a vertical direction away from the ice making cell defined by the first region. As described above, when at least a portion of the second region includes the deformation resistance reinforcement part, the degree of deformation resistance of the second region may be improved with respect to the external force.

For another example, one portion of the second region may further include a support surface connected to a fixed end of the refrigerator (e.g., the bracket, the storage chamber wall, etc.) disposed in a direction away from the ice making cell defined by the other of the second region from the first surface. One portion of the second region may further include a support surface connected to a fixed end of the refrigerator (e.g., the bracket, the storage chamber wall, etc.) disposed in a direction away from the ice making cell defined by the first region from the first surface. As described above, when at least a portion of the second region includes a support surface connected to the fixed end, the degree of deformation resistance of the second region may be improved with respect to the external force.

For another example, the tray assembly may include a first portion defining at least a portion of the ice making cell and a second portion extending from a predetermined point of the first portion. At least a portion of the second portion may extend in a direction away from the ice making cell defined by the first region. At least a portion of the second portion may include an additional deformation resistant resistance reinforcement part. At least a portion of the second portion may further include a support surface connected to the fixed end. As described above, when at least a portion of the second region further includes the second portion, it may be advantageous to improve the degree of deformation resistance of the second region with respect to the external force. This is because the additional deformation resistance reinforcement part is disposed at in the second portion, or the second portion is additionally supported by the fixed end.

For another example, one portion of the second region may include a first through-hole. As described above, when the first through-hole is defined, the ice solidified in the ice making cell of the second region is expanded to the outside of the ice making cell through the first through-hole, and thus, the pressure applied to the second region may be reduced. In particular, when water is excessively supplied to the ice making cell, the first through-hole may be contributed to reduce the deformation of the second region in the process of solidifying the water.

One portion of the second region may include a second through-hole providing a path through which the bubbles contained in the water in the ice making cell of the second region move or escape. When the second through-hole is defined as described above, the transparency of the solidified ice may be improved.

In one portion of the second region, a third through-hole may be defined to press the penetrating pusher. This is because it may be difficult for the non-penetrating type pusher to press the surface of the tray assembly so as to remove the ice when the degree of deformation resistance of the second region increases. The first, second, and third through-holes may overlap each other. The first, second, and third through-holes may be defined in one through-hole.

One portion of the second region may include a mounting part on which the ice separation heater is disposed. The induction of the ice in the ice making cell defined by the second region in the direction of the ice making cell defined by the first region may represent that the ice is first made in the second region. In this case, a time for which the ice is attached to the second region may be long, and the ice separation heater may be required to separate the ice from the second region. The thickness of the tray assembly in the direction of the outer circumferential surface of the ice making cell from the center of the ice making cell may be less than that of the other portion of the second region in which the ice separation heater is mounted. This is because the heat supplied by the ice separation heater increases in amount transferred to the ice making cell. The fixed end may be a portion of the wall defining the storage chamber or a bracket.

The relation between the coupling force of the transparent ice and the tray assembly is as follows.

To induce the ice to be made in the ice making cell defined by the second region in the direction of the ice making cell defined by the first region, it may be advantageous to increase in coupling force between the first and second regions arranged to contact each other. In the process of solidifying the water, when the pressure applied to the tray assembly while expanded is greater than the coupling force between the first and second regions, the ice may be made in a direction in which the first and second regions are separated from each other. In the process of solidifying the water, when the pressure applied to the tray assembly while expanded is low, the coupling force between the first and second regions is low, It also has the advantage of inducing the ice to be made so that the ice is made in a direction of the region having the smallest degree of deformation resistance in the first and second regions.

There may be various examples of a method of increasing the coupling force between the first and second regions. For example, after the water supply is completed, the controller may change a movement position of the driver in the first direction to control one of the first and second regions so as to move in the first direction, and then, the movement position of the driver may be controlled to be additionally changed into the first direction so that the coupling force between the first and second regions increases. For another example, since the coupling force between the first and second regions increase, the degree of deformation resistances or the degree of restorations of the first and second regions may be different from each other with respect to the force applied from the driver so that the driver reduces the change of the shape of the ice making cell by the expanding the ice after the ice making process is started (or after the heater is turned on). For another example, the first region may include a first surface facing the second region. The second region may include a second surface facing the first region. The first and second surfaces may be disposed to contact each other. The first and second surfaces may be disposed to face each other. The first and second surfaces may be disposed to be separated from and coupled to each other. In this case, surface areas of the first surface and the second surface may be different from each other. In this configuration, the coupling force of the first and second regions may increase while reducing breakage of the portion at which the first and second regions contact each other. In addition, there is an advantage of reducing leakage of water supplied between the first and second regions.

The relationship between transparent ice and the degree of restoration is as follows.

The tray assembly may include a first portion that defines at least a portion of the ice making cell and a second portion extending from a predetermined point of the first portion. The second portion is configured to be deformed by the expansion of the ice made and then restored after the ice is removed. The second portion may include a horizontal extension part provided so that the degree of restoration with respect to the horizontal external force of the expanded ice increases. The second portion may include a vertical extension part provided so that the degree of restoration with respect to the vertical external force of the expanded ice increases. Such a configuration may be assisted to induce ice to be made in a direction from the ice making cell defined by the second region to the ice making cell defined by the first region.

The second region may have different degree of restoration in a direction along the outer circumferential surface of the ice making cell. The first region may have different degree of deformation resistance in a direction along the outer circumferential surface of the ice making cell. The degree of restoration of one portion of the first region may be greater than that of the other portion of the first region. Also, the degree of deformation resistance of one portion may be less than that of the other portion. Such a configuration may be assisted to induce ice to be made in a direction from the ice making cell defined by the second region to the ice making cell defined by the first region.

The first and second regions defined to contact each other may have different degree of restoration in the direction along the outer circumferential surface of the ice making cell. Also, the first and second regions may have different degree of deformation resistances in the direction along the outer circumferential surface of the ice making cell. The degree of restoration of one of the first region may be greater than that of one of the second region. Also, the degree of deformation resistance of one of the first regions may be greater than that of one of the second region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in one direction of the first region in which the degree of deformation resistance decreases, or the degree of restoration increases. Here, the degree of restoration may be a degree of restoration after the external force is removed. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, a shape of one portion of the first region may be different from that of the other portion of the first region or different from that of one portion of the second region. A curvature of one portion of the first region may be different from that of the other portion of the first region or different from that of one portion of the second region. A curvature of one portion of the first region may be less than that of the other portion of the first region or less than that of one portion of the second region. One portion of the first region may include a flat surface. The other portion of the first region may include a curved surface. One portion of the second region may include a curved surface. One portion of the first region may include a shape that is recessed in a direction opposite to the direction in which the ice is expanded. One portion of the first region may include a shape recessed in a direction opposite to a direction in which the ice is made. In the ice making process, one portion of the first region may be modified in a direction in which the ice is expanded or a direction in which the ice is made. In the ice making process, in an amount of deformation from the center of the ice making cell toward the outer circumferential surface of the ice making cell, one portion of the first region is greater than the other portion of the first region. In the ice making process, in the amount of deformation from the center of the ice making cell toward the outer circumferential surface of the ice making cell, one portion of the first region is greater than one portion of the second region.

For another example, to induce ice to be made in a direction from the ice making cell defined by the second region to the ice making cell defined by the first region, one portion of the first region may include a first surface defining a portion of the ice making cell and a second surface extending from the first surface and supported by one surface of the other portion of the first region. The first region may be configured not to be directly supported by the other component except for the second surface. The other component may be a fixed end of the refrigerator.

One portion of the first region may have a pressing surface pressed by the non-penetrating type pusher. This is because when the degree of deformation resistance of the first region is low, or the degree of restoration is high, the difficulty in removing the ice by pressing the surface of the tray assembly may be reduced.

An ice making rate, at which ice is made inside the ice making cell, may affect the making of the transparent ice. The ice making rate may affect the transparency of the made ice. Factors affecting the ice making rate may be an amount of cold and/or heat, which are/is supplied to the ice making cell. The amount of cold and/or heat may affect the making of the transparent ice. The amount of cold and/or heat may affect the transparency of the ice.

In the process of making the transparent ice, the transparency of the ice may be lowered as the ice making rate is greater than a rate at which the bubbles in the ice making cell are moved or collected. On the other hand, if the ice making rate is less than the rate at which the bubbles are moved or collected, the transparency of the ice may increase. However, the more the ice making rate decreases, the more a time taken to make the transparent ice may increase. Also, the transparency of the ice may be uniform as the ice making rate is maintained in a uniform range.

To maintain the ice making rate uniformly within a predetermined range, an amount of cold and heat supplied to the ice making cell may be uniform. However, in actual use conditions of the refrigerator, a case in which the amount of cold is variable may occur, and thus, it is necessary to allow a supply amount of heat to vary. For example, when a temperature of the storage chamber reaches a satisfaction region from a dissatisfaction region, when a defrosting operation is performed with respect to the cooler of the storage chamber, the door of the storage chamber may variously vary in state such as an opened state. Also, if an amount of water per unit height of the ice making cell is different, when the same cold and heat per unit height is supplied, the transparency per unit height may vary.

To solve this limitation, the controller may control the heater so that when a heat transfer amount between the cold within the storage chamber and the water of the ice making cell increases, the heating amount of transparent ice heater increases, and when the heat transfer amount between the cold within the storage chamber and the water of the ice making cell decreases, the heating amount of transparent ice heater decreases so as to maintain an ice making rate of the water within the ice making cell within a predetermined range that is less than an ice making rate when the ice making is performed in a state in which the heater is turned off.

The controller may control one or more of a cold supply amount of cooler and a heat supply amount of heater to vary according to a mass per unit height of water in the ice making cell. In this case, the transparent ice may be provided to correspond to a change in shape of the ice making cell.

The refrigerator may further include a sensor measuring information on the mass of water per unit height of the ice making cell, and the controller may control one of the cold supply amount of cooler and the heat supply amount of heater based on the information inputted from the sensor.

The refrigerator may include a storage part in which predetermined driving information of the cooler is recorded based on information on mass per unit height of the ice making cell, and the controller may control the cold supply amount of cooler to be changed based on the information.

The refrigerator may include a storage part in which predetermined driving information of the heater is recorded based on information on mass per unit height of the ice making cell, and the controller may control the heat supply amount of heater to be changed based on the information. For example, the controller may control at least one of the cold supply amount of cooler or the heat supply amount of heater to vary according to a predetermined time based on the information on the mass per unit height of the ice making cell. The time may be a time when the cooler is driven or a time when the heater is driven to make ice. For another example, the controller may control at least one of the cold supply amount of cooler or the heat supply amount of heater to vary according to a predetermined temperature based on the information on the mass per unit height of the ice making cell. The temperature may be a temperature of the ice making cell or a temperature of the tray assembly defining the ice making cell.

When the sensor measuring the mass of water per unit height of the ice making cell is malfunctioned, or when the water supplied to the ice making cell is insufficient or excessive, the shape of the ice making water is changed, and thus the transparency of the made ice may decrease. To solve this limitation, a water supply method in which an amount of water supplied to the ice making cell is precisely controlled is required. Also, the tray assembly may include a structure in which leakage of the tray assembly is reduced to reduce the leakage of water in the ice making cell at the water supply position or the ice making position. Also, it is necessary to increase the coupling force between the first and second tray assemblies defining the ice making cell so as to reduce the change in shape of the ice making cell due to the expansion force of the ice during the ice making. Also, it is necessary to decrease in leakage in the precision water supply method and the tray assembly and increase in coupling force between the first and second tray assemblies so as to make ice having a shape that is close to the tray shape.

The degree of supercooling of the water inside the ice making cell may affect the making of the transparent ice. The degree of supercooling of the water may affect the transparency of the made ice.

To make the transparent ice, it may be desirable to design the degree of supercooling or lower the temperature inside the ice making cell and thereby to maintain a predetermined range. This is because the supercooled liquid has a characteristic in which the solidification rapidly occurs from a time point at which the supercooling is terminated. In this case, the transparency of the ice may decrease.

In the process of solidifying the liquid, the controller of the refrigerator may control the supercooling release part to operate so as to reduce a degree of supercooling of the liquid if the time required for reaching the specific temperature below the freezing point after the temperature of the liquid reaches the freezing point is less than a reference value. After reaching the freezing point, it is seen that the temperature of the liquid is cooled below the freezing point as the supercooling occurs, and no solidification occurs.

An example of the supercooling release part may include an electrical spark generating part. When the spark is supplied to the liquid, the degree of supercooling of the liquid may be reduced. Another example of the supercooling release part may include a driver applying external force so that the liquid moves. The driver may allow the container to move in at least one direction among X, Y, or Z axes or to rotate about at least one axis among X, Y, or Z axes. When kinetic energy is supplied to the liquid, the degree of supercooling of the liquid may be reduced. Further another example of the supercooling release part may include a part supplying the liquid to the container. After supplying the liquid having a first volume less than that of the container, when a predetermined time has elapsed or the temperature of the liquid reaches a certain temperature below the freezing point, the controller of the refrigerator may control an amount of liquid to additionally supply the liquid having a second volume greater than the first volume. When the liquid is divided and supplied to the container as described above, the liquid supplied first may be solidified to act as freezing nucleus, and thus, the degree of supercooling of the liquid to be supplied may be further reduced.

The more the degree of heat transfer of the container containing the liquid increase, the more the degree of supercooling of the liquid may increase. The more the degree of heat transfer of the container containing the liquid decrease, the more the degree of supercooling of the liquid may decrease.

The structure and method of heating the ice making cell in addition to the heat transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

The cold supplied to the ice making cell and the heat supplied to the ice making cell have opposite properties. To increase the ice making rate and/or improve the transparency of the ice, the design of the structure and control of the cooler and the heater, the relationship between the cooler and the tray assembly, and the relationship between the heater and the tray assembly may be very important.

For a constant amount of cold supplied by the cooler and a constant amount of heat supplied by the heater, it may be advantageous for the heater to be arranged to locally heat the ice making cell so as to increase the ice making rate of the refrigerator and/or to increase the transparency of the ice. As the heat transmitted from the heater to the ice making cell is transferred to an area other than the area on which the heater is disposed, the ice making rate may be improved. As the heater heats only a portion of the ice making cell, the heater may move or collect the bubbles to an area adjacent to the heater in the ice making cell, thereby increasing the transparency of the ice.

When the amount of heat supplied by the heater to the ice making cell is large, the bubbles in the water may be moved or collected in the portion to which the heat is supplied, and thus, the made ice may increase in transparency. However, if the heat is uniformly supplied to the outer circumferential surface of the ice making cell, the ice making rate of the ice may decrease. Therefore, as the heater locally heats a portion of the ice making cell, it is possible to increase the transparency of the made ice and minimize the decrease of the ice making rate.

The heater may be disposed to contact one side of the tray assembly. The heater may be disposed between the tray and the tray case. The heat transfer through the conduction may be advantageous for locally heating the ice making cell.

At least a portion of the other side at which the heater does not contact the tray may be sealed with a heat insulation material. Such a configuration may reduce that the heat supplied from the heater is transferred toward the storage chamber.

The tray assembly may be configured so that the heat transfer from the heater toward the center of the ice making cell is greater than that transfer from the heater in the circumference direction of the ice making cell.

The heat transfer of the tray toward the center of the ice making cell in the tray may be greater than the that transfer from the tray case to the storage chamber, or the thermal conductivity of the tray may be greater than that of the tray case. Such a configuration may induce the increase in heat transmitted from the heater to the ice making cell via the tray. In addition, it is possible to reduce the heat of the heater is transferred to the storage chamber via the tray case.

The heat transfer of the tray toward the center of the ice making cell in the tray may be less than that of the refrigerator case toward the storage chamber from the outside of the refrigerator case (for example, an inner case or an outer case), or the thermal conductivity of the tray may be less than that of the refrigerator case. This is because the more the heat or thermal conductivity of the tray increases, the more the supercooling of the water accommodated in the tray may increase. The more the degree of supercooling of the water increase, the more the water may be rapidly solidified at the time point at which the supercooling is released. In this case, a limitation may occur in which the transparency of the ice is not uniform or the transparency decreases. In general, the case of the refrigerator may be made of a metal material including steel.

The heat transfer of the tray case in the direction from the storage chamber to the tray case may be greater than the that of the heat insulation wall in the direction from the outer space of the refrigerator to the storage chamber, or the thermal conductivity of the tray case may be greater than that of the heat insulation wall (for example, the insulation material disposed between the inner and outer cases of the refrigerator). Here, the heat insulation wall may represent a heat insulation wall that partitions the external space from the storage chamber. If the degree of heat transfer of the tray case is equal to or greater than that of the heat insulation wall, the rate at which the ice making cell is cooled may be excessively reduced.

The first region may be configured to have a different degree of heat transfer in a direction along the outer circumferential surface. The degree of heat transfer of one portion of the first region may be less than that of the other portion of the first region. Such a configuration may be assisted to reduce the heat transfer transferred through the tray assembly from the first region to the second region in the direction along the outer circumferential surface.

The first and second regions defined to contact each other may be configured to have a different degree of heat transfer in the direction along the outer circumferential surface. The degree of heat transfer of one portion of the first region may be configured to be less than the degree of heat transfer of one portion of the second region. Such a configuration may be assisted to reduce the heat transfer transferred through the tray assembly from the first region to the second region in the direction along the outer circumferential surface. In another aspect, it may be advantageous to reduce the heat transferred from the heater to one portion of the first region to be transferred to the ice making cell defined by the second region. As the heat transmitted to the second region is reduced, the heater may locally heat one portion of the first region. Thus, it may be possible to reduce the decrease in ice making rate by the heating of the heater. In another aspect, the bubbles may be moved or collected in the region in which the heater is locally heated, thereby improving the transparency of the ice. The heater may be a transparent ice heater.

For example, a length of the heat transfer path from the first region to the second region may be greater than that of the heat transfer path in the direction from the first region to the outer circumferential surface from the first region. For another example, in a thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

As described above, when the thickness of the first region is thin, the heat transfer in the direction of the center of the ice making cell may increase while reducing the heat transfer in the direction of the outer circumferential surface of the ice making cell. For this reason, the ice making cell defined by the first region may be locally heated.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, the tray assembly may include a first portion defining at least a portion of the ice making cell and a second portion extending from a predetermined point of the first portion. The first region may be defined in the first portion. The second region may be defined in an additional tray assembly that may contact the first portion. At least a portion of the second portion may extend in a direction away from the ice making cell defined by the second region. In this case, the heat transmitted from the heater to the first region may be reduced from being transferred to the second region.

The structure and method of cooling the ice making cell in addition to the degree of cold transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

For a constant amount of cold supplied by the cooler and a constant amount of heat supplied by the heater, it may be advantageous to configure the cooler so that a portion of the ice making cell is more intensively cooled to increase the ice making rate of the refrigerator and/or increase the transparency of the ice. The more the cold supplied to the ice making cell by the cooler increases, the more the ice making rate may increase. However, as the cold is uniformly supplied to the outer circumferential surface of the ice making cell, the transparency of the made ice may decrease. Therefore, as the cooler more intensively cools a portion of the ice making cell, the bubbles may be moved or collected to other regions of the ice making cell, thereby increasing the transparency of the made ice and minimizing the decrease in ice making rate.

The cooler may be configured so that the amount of cold supplied to the second region differs from that of cold supplied to the first region so as to allow the cooler to more intensively cool a portion of the ice making cell. The amount of cold supplied to the second region by the cooler may be greater than that of cold supplied to the first region.

For example, the second region may be made of a metal material having a high cold transfer rate, and the first region may be made of a material having a cold rate less than that of the metal.

For another example, to increase the degree of cold transfer transmitted from the storage chamber to the center of the ice making cell through the tray assembly, the second region may vary in degree of cold transfer toward the central direction. The degree of cold transfer of one portion of the second region may be greater than that of the other portion of the second region. A through-hole may be defined in one portion of the second region. At least a portion of the heat absorbing surface of the cooler may be disposed in the through-hole. A passage through which the cold air supplied from the cooler passes may be disposed in the through-hole. The one portion may be a portion that is not surrounded by the tray case. The other portion may be a portion surrounded by the tray case. One portion of the second region may be a portion defining the uppermost portion of the ice making cell in the second region. The second region may include a tray and a tray case locally surrounding the tray. As described above, when a portion of the tray assembly has a high cold transfer rate, the supercooling may occur in the tray assembly having a high cold transfer rate. As described above, designs may be needed to reduce the degree of the supercooling.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 14 is disposed at an upper side, and the freezing compartment 32 is disposed at a lower side. Each of the storage chambers may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner.

The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 falls to be stored may be disposed below the ice maker 200. A user may take out the ice bin 600 from the freezing compartment 32 to use the ice stored in the ice bin 600.

The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

FIG. 2 is a perspective view of an ice maker according to an embodiment, FIG. 3 is a perspective view illustrating a state in which a bracket is removed from the ice maker of FIG. 2, and FIG. 4 is an exploded perspective view of the ice maker according to an embodiment. FIG. 5 is a cross-sectional view taken along line A-A of FIG. 3 for showing a second temperature sensor installed in an ice maker according to an embodiment.

FIG. 6 is a longitudinal cross-sectional view of an ice maker when a second tray is disposed at a water supply position according to an embodiment.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. A water supply part 240 may be installed on the upper side of the inner surface of the bracket 220. The water supply part 240 may be provided with openings at upper and lower sides so that water supplied to the upper side of the water supply part 240 may be guided to the lower side of the water supply part 240.

Since the upper opening of the water supply part 240 is larger than the lower opening thereof, a discharge range of water guided downward through the water supply part 240 may be limited. A water supply pipe to which water is supplied may be installed above the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall for providing the ice making cell 320*a*, and a second tray 380 defining at least another portion of the wall for providing the ice making cell 320*a*.

Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380. In FIG. 4, three ice making cells 320*a* are provided as an example.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. In this case, the first cell 320*b* may be provided in a spherical shape or a shape similar to a spherical shape. Also, the second cell 320*c* may be provided in a spherical shape or a shape similar to a spherical shape. The ice making cell 320*a* may have a rectangular parallelepiped shape or a polygonal shape.

The ice maker 200 may further include a first tray case 300 coupled to the first tray 320.

For example, the first tray case 300 may be coupled to the upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the first heater case 280. The heater case 280 may be integrally formed with the first tray case 300 or may be separately formed.

The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In any cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320.

The first tray cover 340 may be provided with an opening corresponding to a shape of the ice making cell 320*a* of the first tray 320 and may be coupled to a lower surface of the first tray 320.

The first tray case 300 may be provided with a guide slot 302 inclined at an upper side and vertically extending at a lower side. The guide slot 302 may be provided in a member extending upward from the first tray case 300.

A guide protrusion 262 of the first pusher 260, which will be described later, may be inserted into the guide slot 302. Thus, the guide protrusion 262 may be guided along the guide slot 302.

The first pusher 260 may include at least one extension part 264. For example, the first pusher 260 may include the extension part 264 provided with the same number as the number of ice making cells 320*a*, but is not limited thereto. The extension part 264 may push out the ice disposed in the ice making cell 320*a* during the ice separation process. For example, the extension part 264 may be inserted into the ice making cell 320*a* through the first tray case 300. Therefore, the first tray case 300 may be provided with a hole 304 through which a portion of the first pusher 260 passes.

The guide protrusion 262 of the first pusher 260 may be coupled to a pusher link 500. In this case, the guide protrusion 262 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380.

The second tray case 400 may be disposed at a lower side of the second tray to support the second tray 380. For example, at least a portion of the wall defining the second cell 320*a* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may cover the circumferential wall 382.

The ice maker 200 may further include a second heater case 420. A transparent ice heater 430 (or an ice making heater) may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900, which is an example of a cooler, supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. The transparent ice heater 430 may be, for example, a wire type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In any cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a '□' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220. The second pusher 540 may include at least one extension part 544. For example, the second pusher 540 may include the extension part 544 provided with the same number as the number of ice making cells 320*a*, but is not limited thereto. The extension part 544 may push out the ice disposed in the ice making cell 320*a*. For example, the extension part 544 may pass through the second tray case 400 to contact the second tray 380 defining the ice making cell 320*a* and then press the contacting second tray 380. Therefore, the second tray case 400 may be provided with a hole 422 through which a portion of the second pusher 540 passes.

The first tray case 300 may be rotatably coupled to the second tray case 400 with respect to the shaft 440 and then be disposed to change in angle about the shaft 440.

In this embodiment, the second tray 380 may be made of a non-metal material. For example, when the second tray 380 is pressed by the second pusher 540, the second tray 380 may be made of a flexible material which is deformable. Although not limited, the second tray 380 may be made of a silicone material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metal material and the flexible or soft material, after the shape of the second tray 380 is deformed by the second pusher 540, when the pressing force of the second pusher 540 is removed, the second tray 380 may be easily restored to its original shape.

On the other hand, the first tray 320 may be made of a metal material. In this case, since the coupling force or the separating force between the first tray 320 and the ice is strong, the ice maker 200 according to this embodiment may include at least one of the ice separation heater 290 or the first pusher 260.

For another example, the first tray 320 may be made of a non-metal material. When the first tray 320 is made of the non-metal material, the ice maker 200 may include only one of the ice separation heater 290 and the first pusher 260.

Alternatively, the ice maker 200 may not include the ice separation heater 290 and the first pusher 260.

Although not limited, the first tray 320 may be made of a silicone material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

On the other hand, referring to FIG. 5, the ice maker 200 may further include a second temperature sensor (or a tray temperature sensor) 700 that senses the temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*. The second temperature sensor 700 may be installed in the first tray case 300.

In this case, the second temperature sensor 700 may contact the first tray 320, or may be spaced apart from the first tray 320 by a predetermined distance. Alternatively, the second temperature sensor 700 may be installed on the first tray 320 to contact the first tray 320.

Of course, when the second temperature sensor 700 is disposed to pass through the first tray 320, the temperature of water or ice of the ice making cell 320*a* may be directly sensed.

On the other hand, a portion of the ice separation heater 290 may be disposed higher than the second temperature sensor 700 and may be spaced apart from the second temperature sensor 700. An electric wire 701 coupled to the second temperature sensor 700 may be guided above the first tray case 300.

Referring to FIG. 6, the ice maker 200 according to this embodiment may be designed such that the position of the second tray 380 is different in the water supply position and the ice-making position.

For example, the second tray 380 may include a second cell wall 381 defining the second cell 320*c* of the ice making cell 320*a*, and a circumferential wall 382 extending along the outer edge of the second cell wall 381.

The second cell wall 381 may include an upper surface 381*a*. In this specification, the upper surface 381*a* of the second cell wall 381 may be referred to as the upper surface 381*a* of the second tray 380. The upper surface 381*a* of the second cell wall 381 may be disposed lower than the upper end of the circumferential wall 381.

The first tray 320 may include a first cell wall 321*a* defining the first cell 320*b* of the ice making cell 320*a*. The first cell wall 321*a* may include a straight portion 321*b* and a curved portion 321*c*. The curved portion 321*c* may be formed in an arc shape having a center of the shaft 440 as a radius of curvature. Accordingly, the circumferential wall 381 may also include a straight portion and a curved portion corresponding to the straight portion 321*b* and the curved portion 321*c*.

The first cell wall 321*a* may include a lower surface 321*d*. In this specification, the lower surface 321*b* of the first cell wall 321*a* may be referred to as the lower surface 321*b* of the first tray 320. The lower surface 321*d* of the first cell wall 321*a* may contact the upper surface 381*a* of the second cell wall 381*a*.

For example, at least a portion of the lower surface 321*d* of the first cell wall 321*a* and the upper surface 381*a* of the second cell wall 381 may be spaced apart at the water supply position as shown in FIG. 6. In FIG. 6, for example, it is shown that the lower surface 321*d* of the first cell wall 321*a* and the entire upper surface 381*a* of the second cell wall 381 are spaced apart from each other. Accordingly, the upper surface 381*a* of the second cell wall 381 may be inclined to form a predetermined angle with the lower surface 321*d* of the first cell wall 321*a*.

Although not limited, the lower surface 321*d* of the first cell wall 321*a* at the water supply position may be maintained substantially horizontally, and the upper surface 381*a* of the second cell wall 381 may be disposed to be inclined with respect to the lower surface 321*d* of the first cell wall 321*a* under the first cell wall 321*a*.

In the state shown in FIG. 6, the circumferential wall 382 may surround the first cell wall 321*a*. In addition, the upper end of the circumferential wall 382 may be disposed higher than the lower surface 321*d* of the first cell wall 321*a*.

On the other hand, the upper surface 381*a* of the second cell wall 381 may contact at least a portion of the lower surface 321*d* of the first cell wall 321*a* at the ice making position (see FIG. 12).

The angle formed by the upper surface 381*a* of the second tray 380 and the lower surface 321*d* of the first tray 320 at the ice making position is smaller than the angle formed by the upper surface 382*a* of the second tray 380 and the lower surface 321*d* of the first tray 320 at the water supply position. The upper surface 381*a* of the second cell wall 381 may contact the entire lower surface 321*d* of the first cell wall 321*a* at the ice making position. At the ice making position, the upper surface 381*a* of the second cell wall 381 and the lower surface 321*d* of the first cell wall 321*a* may be disposed to be substantially horizontal.

In this embodiment, the water supply position of the second tray 380 and the ice making position are different from each other so that, when the ice maker 200 includes a plurality of ice making cells 320*a*, a water passage for communication between the ice making cells 320*a* is not formed in the first tray 320 and/or the second tray 380, and water is uniformly distributed to the plurality of ice making cells 320*a*.

If the ice maker 200 includes the plurality of ice making cells 320*a*, when the water passage is formed in the first tray 320 and/or the second tray 380, the water supplied to the ice maker 200 is distributed to the plurality of ice making cells 320*a* along the water passage.

However, in a state in which the water is distributed to the plurality of ice making cells 320*a*, water also exists in the water passage, and when ice is made in this state, the ice made in the ice making cell 320*a* is connected by the ice made in the water passage.

In this case, there is a possibility that the ice will stick together even after the ice separation is completed. Even if pieces of ice are separated from each other, some pieces of ice will contain ice made in the water passage, and thus there is a problem that the shape of the ice is different from that of the ice making cell.

However, as in this embodiment, when the second tray 380 is spaced apart from the first tray 320 at the water supply position, water falling into the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* among the plurality of communication holes 321*e*. In this case, the water supplied through the one communication hole 321*e* falls into the second tray 380 after passing through the first tray 320.

During the water supply process, water may fall into any one second cell 320*c* among the plurality of second cells 320*c* of the second tray 380. The water supplied to one second cell 320*c* overflows from one second cell 320*c*.

In this embodiment, since the upper surface 381*a* of the second tray 380 is spaced apart from the lower surface 321*d* of the first tray 320, the water that overflows from one of the second cells 320*c* moves to another adjacent second cell 320*c* along the upper surface 381*a* of the second tray 380. Accordingly, the plurality of second cells 320*c* of the second tray 380 may be filled with water.

In addition, in a state in which the supply of water is completed, a portion of the supplied water is filled in the second cell 320*c*, and another portion of the supplied water may be filled in a space between the first tray 320 and the second tray 380.

Water at the water supply position when water supply is completed may be positioned only in the space between the first tray 320 and the second tray 380, the space between the first tray 320 and the second tray 380, and the first tray 320 according to the volume of the ice making cell 320*a* (see FIG. 11).

When the second tray 380 moves from the water supply position to the ice making position, the water in the space between the first tray 320 and the second tray 380 may be uniformly distributed to the plurality of first cells 320*b*.

On the other hand, when the water passage is defined in the first tray 320 and/or the second tray 380, ice made in the ice making cell 320*a* is also made in the water passage portion.

In this case, when the controller of the refrigerator controls one or more of the cooling power of the cooling air supply part 900 and the heating amount of the transparent ice heater 430 to vary according to the mass per unit height of water in the ice making cell 320*a* in order to make transparent ice, one or more of the cooling power of the cold air supply means 900 and the heating amount of the transparent ice heater 430 are controlled to rapidly vary several times or more in the portion where the water passage is defined.

This is because the mass per unit height of water is rapidly increased several times or more in the portion where the water passage is defined. In this case, since the reliability problem of the parts may occur and expensive parts with large widths of maximum and minimum output may be used, it can also be disadvantageous in terms of power consumption and cost of parts. As a result, the present disclosure may require a technology related to the above-described ice making position so as to make transparent ice.

FIG. 7 is a block diagram illustrating a control of a refrigerator according to an embodiment.

Referring to FIG. 7, the refrigerator according to this embodiment may further include a cold air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary. Therefore, in this embodiment, the cold air supply part 900 may include one or more of the compressor, the fan, and the refrigerant valve.

The refrigerator according to this embodiment may further include a controller 800 that controls the cold air supply part 900. The refrigerator may further include a water supply valve 242 controlling an amount of water supplied through the water supply part 240.

The refrigerator may further include a defrosting heater 920 that defrosts the evaporation for supplying cold air to the freezing compartment 32. The defrosting heater 920 may be installed in the evaporator or positioned around the evaporator to supply heat to the evaporator.

The controller 800 may control a portion or all of the ice separation heater 290, the transparent ice heater 430, the driver 480, the cold air supply part 900, the water supply valve 242, and the defrosting heater 920.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32. The controller 800 may control the cold air supply part 900 based on the temperature sensed by the first temperature sensor 33. The controller 800 may determine whether ice making is completed based on the temperature sensed by the second temperature sensor 700.

FIG. 8 is a flowchart for explaining a process of making ice in the ice maker according to an embodiment.

FIG. 9 is a view for explaining a height reference depending on a relative position of the transparent heater with respect to the ice making cell, and FIG. 10 is a view for explaining an output of the transparent heater per unit height of water within the ice making cell.

FIG. 11 is a view illustrating a state in which supply of water is completed at a water supply position, FIG. 12 is a view illustrating a state in which ice is made at an ice making position, FIG. 13 is a view illustrating a state in which a second tray is separated from a first tray during an ice separation process, and FIG. 14 is a view illustrating a state in which a second tray is moved to an ice separation position during an ice separation process.

Referring to FIGS. 6 to 14, to make ice in the ice maker 200, the controller 800 moves the second tray 380 to a water supply position (S1).

In this specification, a direction in which the second tray 380 moves from the ice making position of FIG. 12 to the ice separation position of FIG. 14 may be referred to as forward movement (or forward rotation). On the other hand, the direction from the ice separation position of FIG. 14 to the water supply position of FIG. 11 may be referred to as reverse movement (or reverse rotation).

The movement to the water supply position of the second tray 380 is detected by a sensor, and when it is detected that the second tray 380 moves to the water supply position, the controller 800 stops the driver 480.

The water supply starts when the second tray 380 moves to the water supply position (S2). For the water supply, the controller 800 turns on the water supply valve 242, and when it is determined that a predetermined amount of water is supplied, the controller 800 may turn off the water supply valve 242. For example, in the process of supplying water, when a pulse is outputted from a flow sensor (not shown), and the outputted pulse reaches a reference pulse, it may be determined that a predetermined amount of water is supplied.

After the water supply is completed, the controller 800 controls the driver 480 to allow the second tray 380 to move to the ice making position (S3). For example, the controller 800 may control the driver 480 to allow the second tray 380 to move from the water supply position in the reverse direction.

When the second tray 380 move in the reverse direction, the upper surface 381*a* of the second tray 380 comes close to the lower surface 321*e* of the first tray 320. Then, water between the upper surface 381*a* of the second tray 380 and the lower surface 321*e* of the first tray 320 is divided into each of the plurality of second cells 320*c* and then is distributed. When the upper surface 381*a* of the second tray 380 and the lower surface 321*e* of the first tray 320 are completely in close contact, the first cell 320*b* is filled with water.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). For example, the ice making may be started when the second tray 380 reaches the ice making position. Alternatively, when the second tray 380 reaches the ice making position, and the water supply time elapses, the ice making may be started. When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*.

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S5).

In this embodiment, the transparent ice heater 430 is not turned on immediately after the ice making is started, and the transparent ice heater 430 may be turned on only when the turn-on condition of the transparent ice heater 430 is satisfied (S6).

Generally, the water supplied to the ice making cell 320*a* may be water having normal temperature or water having a temperature lower than the normal temperature. The temperature of the water supplied is higher than a freezing point of water.

Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature sensed by the second temperature sensor 700 reaches a turn-on reference temperature.

For example, the turn-on reference temperature may be a temperature for determining that water starts to freeze at the uppermost side (communication hole side) of the ice making cell 320*a*.

When a portion of the water is frozen in the ice making cell 320*a*, the temperature of the ice in the ice making cell 320*a* is below zero. The temperature of the first tray 320 may be higher than the temperature of the ice in the ice making cell 320*a*.

Alternatively, although water is present in the ice making cell 320*a*, after the ice starts to be made in the ice making cell 320*a*, the temperature sensed by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the control part 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and a sum of the turn-on time and the turn-off time of the transparent ice heater 430 in one cycle, or a ratio of the turn-ff time and a sum of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in FIG. 9(*a*), the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*.

In the case of FIG. 9(*a*), ice is made from the uppermost side of the ice making cell 320*a* and then is grown. On the other hand, as shown in FIG. 9(*b*), the transparent ice heater 430 at the bottom surface of the ice making cell 320*a* may be disposed to have different heights. In this case, since heat is supplied to the ice making cell 320*a* at different heights of the ice making cell 320*a*, ice is made with a pattern different from that of FIG. 9(*a*).

For example, in FIG. 9(*b*), ice may be made at a position spaced apart from the uppermost side to the left side of the ice making cell 320*a*, and the ice may be grown to a right lower side at which the transparent ice heater 430 is disposed.

Accordingly, in FIG. 9(*b*), a line (reference line) perpendicular to the line connecting two points of the transparent ice heater 430 serves as a reference for the unit height of water of the ice making cell 320*a*. The reference line of FIG. 9(*b*) is inclined at a predetermined angle from the vertical line.

FIG. 10 illustrates a unit height division of water and an output amount of transparent ice heater per unit height when the transparent ice heater is disposed as shown in FIG. 9(*a*).

Hereinafter, an example of controlling an output of the transparent ice heater so that the ice making rate is constant for each unit height of water will be described.

Referring to FIG. 10, when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections, Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value.

Since the volume of the section D is less than that of the section E, the volume of the ice may be reduced as the volume decreases, and thus it is necessary to delay the ice making rate. Thus, an output W4 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D. Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is maximum. The output of the transparent ice heater 430 may again increase step by step from the next The output of the transparent ice heater 430 in two adjacent sections may be set to be the same according to the type or mass of the made ice. For example, the output of section C and section D may be the same. That is, the output of the transparent ice heater 430 may be the same in at least two sections.

Alternatively, the output of the transparent ice heater 430 may be set to the minimum in sections other than the section in which the mass per unit height is the smallest.

For example, the output of the transparent ice heater 430 in the section D or the section F may be minimum. The output of the transparent ice heater 430 in the section E may be equal to or greater than the minimum output.

In summary, in this embodiment, the output of the transparent ice heater 430 may have a maximum initial output. In the ice making process, the output of the transparent ice heater 430 may be reduced to the minimum output of the transparent ice heater 430.

The output of the transparent ice heater 430 may be gradually reduced in each section, or the output may be maintained in at least two sections.

The output of the transparent ice heater 430 may increase from the minimum output to the end output. The end output may be the same as or different from the initial output.

In addition, the output of the transparent ice heater 430 may incrementally increase in each section from the minimum output to the end output, or the output may be maintained in at least two sections.

Alternatively, the output of the transparent ice heater 430 may be an end output in a section before the last section among a plurality of sections. In this case, the output of the transparent ice heater 430 may be maintained as an end output in the last section. That is, after the output of the transparent ice heater 430 becomes the end output, the end output may be maintained until the last section.

As the ice making is performed, an amount of ice existing in the ice making cell 320*a* may decrease. Thus, when the transparent ice heater 430 continues to increase until the output reaches the last section, the heat supplied to the ice making cell 320*a* may be reduced. As a result, excessive water may exist in the ice making cell 320*a* even after the end of the last section.

Therefore, the output of the transparent ice heater 430 may be maintained as the end output in at least two sections including the last section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass for each unit height of water is minimum. The cooling power of the cold air supply part 900 may be gradually reduced again from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

On the other hand, the method for controlling the transparent ice heater for making transparent ice may include a basic heating process.

The basic heating process may include a plurality of processes. In each of the plurality of processes, the output of the transparent ice heater 430 may be determined based on the mass per unit height of water in the ice making cell 320*a*.

When the on condition of the transparent ice heater 430 is satisfied, the first process of the basic heating process may be started. In the first process, the transparent ice heater 430 may operate with a first output (initial output).

When the first process starts and the first set time elapses, the second process may start. At least one of the plurality of processes may be performed for the first set time. For example, the time at which each of the plurality of processes is performed may be the same as the first set time. That is, when each process starts and the first set time elapses, each process may be ended and the next process may be performed. Accordingly, the output of the transparent ice heater 430 may be variably controlled over time.

In the first process of the plurality of processes, the transparent ice heater 430 may operate with a second output (final output) for the first set time. After the transparent ice heater 430 operates with the second output for the first set time, the transparent ice heater 430 may operate with the second output until the temperature sensed by the second temperature sensor 700 reaches a limit temperature.

That is, the controller 800 may determine whether the ice making is completed based on the temperature sensed by the second temperature sensor 700 (S8).

For example, when the transparent ice heater 430 operates with the final output for the first set time and the temperature sensed by the second temperature sensor 700 reaches the limit temperature, the controller 800 may determine that the ice making is completed. In this case, the transparent ice heater 430 may be turned off (S9).

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches an end reference temperature.

Alternatively, when the transparent ice heater 430 operates with the final output for the first set time and the temperature sensed by the second temperature sensor 700 reaches the limit temperature, the controller 800 may end the basic heating process and perform the additional heating process.

That is, the method for controlling the transparent ice heater for making transparent ice may further include a basic heating process and an additional heating process. When the transparent ice heater 430 is turned on in the additional heating process and the temperature sensed by the second temperature sensor 700 reaches the end reference temperature, the controller 800 may determine that ice making has been completed (S8).

For another example, when the transparent ice heater 430 is turned on in the additional heating process and the temperature sensed by the second temperature sensor 700 reaches the end reference temperature after the elapse of the holding time, the controller 800 may determine that ice making has been completed (S8). In this case, the transparent ice heater 430 may be turned off.

When the transparent ice heater 430 is turned on in the additional heating process and the temperature sensed by the second temperature sensor 700 reaches the end reference temperature before the elapse of the holding time, the controller 800 may determine that ice making has been completed after the elapse of the holding time (S8). In this case, the transparent ice heater 430 may be turned off.

When it is determined that the ice making is completed, the controller 800 may turn off the transparent ice heater 430 (S9).

When the ice making is completed, the controller 800 operates one or more of the ice separation heater 290 and the transparent ice heater 430 (S10).

When at least one of the ice separation heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the lower surface 321*d* of the first tray 320 and the upper surface 381*a* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on (S10). Although not limited, the turn-off reference temperature may be set to above zero temperature.

The controller 800 operates the driver 480 to allow the second tray 380 to move in the forward direction (S11).

As illustrated in FIG. 13, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, ice may be separated from the surface of the first tray 320 by the heater that is turned on. In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320. The ice separated from the first tray 320 may be supported by the second tray 380 again.

When the ice moves together with the second tray 380 while the ice is supported by the second tray 380, the ice may be separated from the tray 250 by its own weight even if no external force is applied to the second tray 380.

While the second tray 380 moves, even if the ice does not fall from the second tray 380 by its own weight, when the second pusher 540 presses the second tray 380 as illustrated in FIG. 13, the ice may be separated from the second tray 380 to fall downward.

Specifically, as illustrated in FIG. 13, while the second tray 380 moves, the second tray 380 may contact the extension part 544 of the second pusher 540.

When the second tray 380 continuously moves in the forward direction, the extension part 544 may press the second tray 380 to deform the second tray 380. Thus, the pressing force of the extension part 544 may be transferred to the ice so that the ice is separated from the surface of the second tray 380. The ice separated from the surface of the second tray 380 may drop downward and be stored in the ice bin 600.

In this embodiment, as shown in FIG. 14, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the ice state.

After the ice is separated from the second tray 380, the controller 800 controls the driver 480 to allow the second tray 380 to move in the reverse direction (S11). Then, the second tray 380 moves from the ice separation position to the water supply position.

When the second tray 380 moves to the water supply position of FIG. 6, the controller 800 stops the driver 480 (S1).

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

On the other hand, in this embodiment, cooling power of the cold air supply part 900 may be determined corresponding to the target temperature of the freezing compartment 32. The cold air generated by the cold air supply part 900 may be supplied to the freezing compartment 32.

The water of the ice making cell 320*a* may be phase-changed into ice by heat transfer between the cold water supplied to the freezing compartment 32 and the water of the ice making cell 320*a*.

In this embodiment, a heating amount of the transparent ice heater 430 for each unit height of water may be determined in consideration of predetermined cooling power of the cold air supply part 900.

In this embodiment, the heating amount (or output) of the transparent ice heater 430 determined in consideration of the predetermined cooling power of the cold air supply part 900 is referred to as a reference heating amount (or reference output). The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, the case in which the heat transfer amount between the cold and the water decrease may be a case in which the cooling power of the cold air supply part 900 decreases, a case in which the air having a temperature higher than the temperature of the cold air in the freezing compartment 32 is supplied to the freezing compartment 32, or a case in which the defrosting heater 920 is turned on.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the heat transfer amount of the cold air and the water increases, the temperature of the cold air around the ice maker 200 is lowered to increase in ice making rate.

On the other hand, if the heat transfer amount of the cold air and the water decreases, the temperature of the cold air around the ice maker 200 increases, the ice making rate decreases, and the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

Hereinafter, a case in which the heat transfer amount of cold air and water is reduced by the operation of the defrosting heater will be described as an example.

FIG. 15 is a flowchart for explaining a method for controlling a transparent ice heater when a defrosting process of an evaporator is started in an ice making process, and FIG. 16 is a view illustrating a change in output of a transparent ice heater for each unit height of water and a change in temperature detected by a second temperature sensor during an ice making process.

Referring to FIGS. 15 and 16, ice making may be started (S4), and the transparent ice heater 430 may be turned on during the ice making process to make ice.

In the ice making process, the cold air supply part 900 may operate with a predetermined cooling power. For example, the compressor may be turned on, and the fan may operate with a predetermined output.

In the ice making process, the controller 800 may determine whether a defrosting start condition is satisfied (S22). As an example, when the cumulative operation time of the compressor, which is one component of the cold air supply part 900, reaches the defrosting reference time, the controller 800 may determine that the defrosting start condition is satisfied. However, in this embodiment, it is noted that there is no limitation on the method for determining whether the defrosting start condition is satisfied.

When the defrosting start condition is satisfied, a defrosting process may be performed.

In this embodiment, the defrosting process may include a defrosting process (or a heat input process) in which the defrosting heater 920 is turned on (S23). When the defrosting heater 920 is turned on, the cooling power of the cold air supply part 900 may be reduced (S24). For example, one or more of the compressor and the fan may be turned off. That is, the amount of cold supplied by the cooler may be reduced.

Of course, when the cooling power of the cold air supply part 900 is reduced, the defrosting heater 920 may be turned on. That is, while the defrosting process is being performed, the defrosting heater 920 may be turned on or the cooling power of the cold air supply part 900 may be reduced.

The controller 800 may maintain the on state of the transparent ice heater 430 for ice making in at least partial section of the defrosting process in a state in which the defrosting heater 920 is turned on.

Even if the defrosting heater 920 is turned on and the heat of the defrosting heater 920 is transferred to the freezing compartment 32, low-temperature cold air remains in the freezing compartment 32. Therefore, if the transparent ice heater 430 is turned off, ice may be frozen in a portion adjacent to the transparent ice heater 430 in the ice making cell 320*a*, and thus transparency of the ice may be deteriorated. Accordingly, even if the defrosting heater 920 is turned on, the controller 800 may maintain the transparent ice heater 430 in the on state.

However, after the defrosting heater 920 is turned on, the controller 800 may determine whether a reduction in the heating amount of the transparent ice heater 430 (hereinafter, referred to as "output" as an example) is required (S25).

If it is necessary to reduce the output of the transparent ice heater 430, the controller 800 may reduce the output of the transparent ice heater 430 (S26). On the other hand, if it is unnecessary to reduce the output of the transparent ice heater 430, the controller 800 may maintain the output of the transparent ice heater 430 (S27).

If the cooling power of the cold air supply part 900 decreases and the defrosting heater 920 is turned on, the temperature of the freezing compartment 32 increases, and the heat transfer amount of the cold air and water decreases.

In this embodiment, in the ice making process, the output of the transparent ice heater 430 is controlled to vary for each unit height of water (or for each section). At the start of the defrosting process, the output of the transparent ice heater 430 may be varied or maintained at the current output according to the current output of the transparent ice heater 430.

For example, referring to FIG. 16(*b*), if the current output of the transparent ice heater 430 at the start of the defrosting process is less than or equal to a preset output (or reference value), the output of the transparent ice heater 430 may be maintained. That is, if the current output of the transparent ice heater 430 is less than or equal to the preset output, it is determined that a reduction in the output of the transparent ice heater 430 is unnecessary, and the output of the transparent ice heater 430 may be maintained. The preset output may be a minimum output among reference outputs determined for each unit height of water.

On the other hand, referring to FIG. 16(*a*) or 16(*b*), if the current output of the transparent ice heater 430 at the start of the defrosting process is greater than the preset output (or reference value), the output of the transparent ice heater 430 may be reduced compared to the output of the transparent ice heater 430 before the start of the defrosting process.

In this specification, among a plurality of sections in which the reference output of the transparent ice heater 430 varies during the ice making process, a section in which the reference output of the transparent ice heater 430 is the minimum or maximum may be referred to as an intermediate section. If the ice making cell has a spherical shape, as shown in FIGS. 10 and 16, a section in which the reference output of the transparent ice heater 430 is the minimum may be an intermediate section.

In this case, if the starting point of the defrosting process is a section before the intermediate section (for example, section E) among the plurality of sections (sections A to I), the controller 800 may determine that it is necessary to reduce the output of the transparent ice heater 430.

As an example, if the output of the transparent ice heater 430 in the next section is less than the output of the transparent ice heater 430 in the section when the defrosting process starts, the controller 800 may perform control so that the heating amount of the transparent ice heater 430 is changed to the heating amount in the next section.

Referring to FIGS. 10 and 16(*a*), when the defrosting process starts in section B in the ice making process, the controller 800 may, for example, reduce the output of the transparent ice heater 430 and may reduce the output of the transparent ice heater 430 to the output W3 corresponding to the section C that is the next section.

As such, by reducing the output of the transparent ice heater 430, it is possible to prevent excessive heat from being provided to the ice making cell 320*a*, and it is possible to reduce unnecessary power consumption of the transparent ice heater 430.

As such, from the next section after reducing the output of the transparent ice heater 430, variable control of the output of the transparent ice heater 430 may be performed for each section before the start of the defrosting process (S28).

For example, the variable control of the output of the transparent ice heater 430 is normally performed when a set time elapses in a state in which the output of the transparent ice heater 430 is reduced, or when the temperature sensed by the second temperature sensor 700 reaches a section reference temperature corresponding to the next section of the section in which the output is reduced.

Specifically, while the transparent ice heater 430 operates with the output of W2 in the section B, when the defrosting process starts, the output of the transparent ice heater 430 is reduced and operates with the output of W3.

When the temperature sensed by the second temperature sensor 700 reaches the section reference temperature corresponding to the section C, which is the section next to the section B, or the section B starts and the set time elapses, the controller 800 causes the transparent ice heater 430 to operate with the output of W3 so as to correspond to the output W3 of the section C.

Sequentially, the output may be adjusted so that the transparent ice heater 430 operates with the reference output corresponding to the sections D to H.

For another example, if the starting point of the defrosting process is a section after the intermediate section (for example, section E) among the plurality of sections (sections A to I), the controller 800 may determine that it is necessary to reduce the output of the transparent ice heater 430.

Referring to FIGS. 10 and 16(*c*), if the defrosting process starts in section G in the ice making process, the controller 800 may reduce the output of the transparent ice heater 430 and may reduce the output of the transparent ice heater 430 to the output W6 corresponding to the section F that is the previous section.

As such, by reducing the output of the transparent ice heater 430, it is possible to prevent excessive heat from being provided to the ice making cell 320*a*, and it is possible to reduce unnecessary power consumption of the transparent ice heater 430.

As such, from the next section after reducing the output of the transparent ice heater 430, variable control of the output of the transparent ice heater 430 may be performed for each section before the start of the defrosting process (S28).

For example, the variable control of the output of the transparent ice heater 430 is normally performed when a set time elapses in a state in which the output of the transparent ice heater 430 is reduced, or when the temperature sensed by the second temperature sensor 700 reaches a section reference temperature corresponding to the next section of the section in which the output is reduced.

Specifically, while the transparent ice heater 430 operates with the output of W7 in the section G, when the defrosting process starts, the output of the transparent ice heater 430 is reduced and operates with the output of W6.

When the temperature sensed by the second temperature sensor 700 reaches the section reference temperature corresponding to the section H, which is the section next to the section G, or the section G starts and the set time elapses, the controller 800 causes the transparent ice heater 430 to operate with the output of W8 so as to correspond to the output W8 of the section H.

Sequentially, the output may be adjusted so that the transparent ice heater 430 operates with the reference output corresponding to the section I.

In summary, when it is necessary to reduce the output of the transparent ice heater 430, the controller 800 reduces the output of the transparent ice heater 430 only in the current section, and when the next section starts, the controller 800 normally performs the variable control of the output of the transparent ice heater 43 in the next section (S28).

As another example, whether it is necessary to reduce the output of the transparent ice heater 430 may be determined based on the temperature detected by the second temperature sensor 700 after the start of the defrosting process.

That is, the output of the transparent ice heater 430 may be varied or the current output may be maintained, based on the temperature change detected by the second temperature sensor 700 after the start of the defrosting process.

For example, after the start of the defrosting process, if the temperature detected by the second temperature sensor 700 is less than the reference temperature value, the output of the transparent ice heater 430 may be maintained.

On the other hand, after the start of the defrosting process, if the temperature detected by the second temperature sensor 700 is equal to or greater than the reference temperature value, the output of the transparent ice heater 430 may be reduced.

Referring to FIG. 16, in the normal ice making process, the temperature detected by the second temperature sensor 700 decreases as time elapses. That is, in each of the plurality of sections, the temperature has a decreasing pattern.

When the defrosting heater 920 is turned on, there is a possibility that the temperature of the ice making cell 320*a* will increase due to the heat of the defrosting heater 920.

In an embodiment, even if the defrosting heater 920 is turned on, when the change in temperature detected by the second temperature sensor 700 is small, the output of the transparent ice heater 430 may not be reduced.

On the other hand, even if the defrosting heater 920 is turned on, when the change in temperature detected by the second temperature sensor 700 is large, the output of the transparent ice heater 430 may be reduced.

In this case, the reference temperature value for determining whether it is necessary to reduce the output of the transparent ice heater 430 may be a reference temperature for changing the section.

When the variable control of the output of the transparent ice heater 430 is performed during the normal ice making process, the timing at which the output of the transparent ice heater 430 varies may be determined by time or the temperature sensed by the second temperature sensor 700.

For example, when the transparent ice heater 430 starts operating with the reference output corresponding to the current section and the set time elapses, the output of the transparent ice heater 430 may be changed to the reference output corresponding to the next section. In this case, the reference temperature for changing the section is predetermined in a memory independently of the set time.

That is, the reference temperature of each of the plurality of sections may be predetermined and stored in the memory. In this embodiment, the reference temperature is not used in the normal ice making process, but may be used only when determining whether it is necessary to reduce the output of the transparent ice heater 430 after the defrosting process starts.

As another example, when the transparent ice heater 430 starts operating with the reference output corresponding to the current section and the temperature reaches the reference temperature for changing the section, the output of the transparent ice heater 430 may be changed to the reference output corresponding to the next section.

In this case, the reference temperature of each of the plurality of sections may be predetermined and stored in the memory. Even in the normal ice making process, the variable control of the output of the transparent ice heater 430 may be performed using the reference temperature.

If the output of the transparent ice heater 430 decreases at the start of the defrosting process when using the reference temperature for changing the section as described above, the time it takes for the second temperature sensor 700 to reach the reference temperature for the start of the next section increases.

Consequently, in the whole ice making process, the total time for which the transparent ice heater is turned on for ice making when the defrosting process starts during the ice making process may be longer than the total time for which the transparent ice heater is turned on for ice making when the defrosting process is not performed during the ice making process.

In any case, after the start of the defrosting process, when the temperature sensed by the second temperature sensor 700 becomes higher than the reference temperature corresponding to the previous section, it may be determined that it is necessary to reduce the output of the transparent ice heater 430.

On the other hand, the defrosting process may further include a pre-defrosting process, which is performed before the start of the defrosting process, according to the type of refrigerator. The pre-defrosting process refers to a process of reducing the temperature of the freezing compartment 32 before the defrosting heater 920 operates. That is, if the defrosting heater 920 is turned on, the temperature of the freezing compartment 32 is increased by the heat of the defrosting heater 920. Thus, in preparation for an increase in the temperature of the freezing compartment 32, the temperature of the freezing compartment 32 may be lowered in advance.

When the pre-defrosting process starts, the cooling power of the cold air supply part 900 may be increased. In this embodiment, when the cooling power of the cold air supply part 900 is increased, the output of the transparent ice heater 430 may be increased as described above. That is, in the pre-defrosting process, the output of the transparent ice heater 430 may be increased.

However, if the time to perform the pre-defrosting process is short, it may be unnecessary to change the output of the transparent ice heater 430. Thus, in the pre-defrosting process, the output of the transparent ice heater 430 may be maintained regardless of an increase in the cooling power of the cold air supply part 900.

In addition, the defrosting process may further include a post-defrosting process, which is performed after the defrosting process, according to the type of refrigerator. The post-defrosting process refers to a process of rapidly reducing the temperature of the freezing compartment 32, of which the temperature is increased after the defrosting heater 920 is turned off.

That is, if the defrosting heater 920 is turned on, the temperature of the freezing compartment 32 is increased by the heat of the defrosting heater 920. Thus, it is necessary to rapidly reduce the temperature of the freezing compartment 32, of which the temperature is increased after the defrosting heater 920 is turned off.

When the post-defrosting process starts, the cooling power of the cold air supply part 900 may be increased more than the cooling power of the cold air supply part 900 before the start of the defrosting process. In this embodiment, when the cooling power of the cold air supply part 900 is increased, the output of the transparent ice heater 430 may be increased as described above. That is, in the post-defrosting process, the output of the transparent ice heater 430 may be increased.

According to this embodiment, even if the defrosting process is started in the ice making process, the transparent ice heater maintains an on state, thereby preventing ice from being made in a portion adjacent to the transparent ice heater in the defrosting process and preventing the transparency of transparent ice from deteriorating.

In addition, in the ice making process, the output is reduced when it is necessary to reduce the output of the transparent ice heater after the defrosting process is started, thereby reducing power consumption of the transparent ice heater.

In the present disclosure, the "operation" of the refrigerator may be defined as including four operation processes: a process of determining whether the start condition of the operation is satisfied, a process in which a predetermined operation is performed when the start condition is satisfied, a process of determining whether the end condition of the operation is satisfied, and a process in which the operation is ended when the end condition is satisfied.

In the present disclosure, the "operation" of the refrigerator may be classified into a general operation for cooling the storage chamber of the refrigerator and a special operation for starting when a special condition is satisfied.

The controller 800 of the present disclosure may perform control so that, when the normal operation and the special operation collide, the special operation is preferentially performed, and the normal operation is stopped.

When the execution of the special operation is completed, the controller 800 may control the normal operation to resume.

In the present disclosure, the collision of the operation may be defined as a case in which the start condition of operation A and the start condition of operation B are satisfied at the same time, a case in which the start condition of operation A is satisfied and the start condition of operation B is satisfied while operation A is being performed, and a case in which when the start condition of operation B is satisfied and the start condition of operation A is satisfied while the operation is being performed.

On the other hand, the general operation for generating transparent ice (hereinafter referred to as "first transparent ice operation") may be defined as an operation in which, after the water supply to the ice making cell 320*a* is completed, the controller 800 controls at least one of the cooling power of the cold air supply part 900 or the heating amount of the transparent ice heater 430 to vary in order to perform a typical ice making process.

The first transparent ice operation may include a process in which the controller 800 controls the cold air supply part 900 to supply cold air to the ice making cell 320*a*.

The first transparent ice operation may include a process in which the controller 800 may control the heater to be turned on in at least partial section while the cold air supply part supplies the cold air so that bubbles dissolved in the water within the ice making cell 320*a* moves from a portion, at which the ice is made, toward the water that is in a liquid state to make transparent ice.

The controller 800 may control the turned-on heater to be varied by a predetermined reference heating amount in each of a plurality of pre-divided sections.

The plurality of pre-divided sections may include at least one of a case in which the sections are classified based on the unit height of the water to be iced, a case in which the sections are divided based on the elapsed time after the second tray 380 moves to the ice making position, and a case in which the sections are divided based on the temperature detected by the second temperature sensor 700 after the second tray 380 moves to the ice making position.

On the other hand, the special operation for making transparent ice may include a transparent ice operation for door load response, which performs the ice making process when the start condition of the door load response operation is satisfied, and a transparent ice operation for defrosting response to perform the ice making process when the start condition of the defrosting operation is satisfied.

The transparent ice operation (hereinafter referred to as "the second transparent ice operation") for defrosting response may include a process in which the controller 800 reduces the cooling power of the cold air supply part 900 in the defrosting process more than the cooling power of the cold air supply part 900 before the defrosting start condition is satisfied.

The second transparent ice operation may include a process in which the controller 800 turns on the defrosting heater 920 in at least some sections of the defrosting process.

The second transparent ice operation may include a process in which, when the start condition of the defrosting response operation for the transparent ice heater is satisfied, the deterioration of the ice making efficiency is reduced by the lowering of the ice making rate due to the heat load applied during the defrosting process, and in order to maintain the ice making rate within a predetermined range and uniformly maintain the transparency of ice, the controller reduces the heating amount of the transparent ice heater compared to the heating amount of the transparent ice heater during the first transparent ice operation.

The start condition of the defrosting response operation for the transparent ice heater may refer to a case in which whether the heating amount of the transparent ice heater needs to vary is determined during the defrosting process, and it is determined that the heating amount of the transparent ice heater needs to vary.

A case in which the start condition of the defrosting response operation for the transparent ice heater is satisfied may include at least one of a case in which the second set time elapses after the defrosting process is performed, a case in which the temperature detected by the second temperature sensor 700 after the defrosting process is performed is equal to or higher than a second set temperature, a case in which, after the defrosting process is performed, the temperature is higher than the temperature detected by the second temperature sensor 700 by the second set value or more, a case in which the amount of change in temperature detected by the second temperature sensor 700 per unit time after the defrosting process is performed is greater than 0, a case in which, after the defrosting process is performed, the heating amount of the transparent ice heater 430 is greater than a reference value, and a case in which the start condition of the defrosting process operation is satisfied.

A case in which the end condition of the defrosting response operation for the transparent ice heater is satisfied may include at least one of a case in which the B set time elapses after the defrosting response operation is performed, a case in which the temperature detected by the second temperature sensor 700 after the defrosting response operation is performed is equal to or higher than the B set temperature, a case in which, after the defrosting response operation is performed, the temperature is lower than the temperature detected by the second temperature sensor 700 by the B set value or more, a case in which the amount of change in temperature detected by the second temperature sensor 700 per unit time after the defrosting response operation is performed is less than 0, and a case in which the end condition of the defrosting process operation is satisfied.

The second transparent ice operation may include a process in which the controller 800 increases the cooling power of the cold air supply part 900 in the pre-defrosting process compared to the cooling power of the cold air supply part 900 before the defrosting start condition is satisfied.

The second transparent ice operation may include a process in which the controller 800 increases the heating amount of the transparent ice heater 430 in response to the increase in the cooling power of the cold air supply part 900 in the pre-defrosting process.

The second transparent ice operation may include a process in which the controller 800 increases the cooling power of the cold air supply part 900 in the post-defrosting process compared to the cooling power of the cold air supply part 900 before the defrosting start condition is satisfied.

The second transparent ice operation may include a process in which the controller 800 increases the heating amount of the transparent ice heater 430 in response to the increase in the cooling power of the cold air supply part 900 in the post-defrosting process.

The controller 800 may control the first transparent ice operation to resume after the end condition of the post-defrosting process operation is satisfied.

Another embodiment will be described.

Referring to FIGS. 10 and 16(*a*) again, when the defrosting process starts in section B in the ice making process, the controller 800 may, for example, reduce the output of the transparent ice heater 430 and may reduce the output of the transparent ice heater 430 to the output W3 corresponding to the section C that is the next section.

As such, by reducing the output of the transparent ice heater 430, it is possible to prevent excessive heat from being provided to the ice making cell 320*a*, and it is possible to reduce unnecessary power consumption of the transparent ice heater 430.

When the defrosting process is completed, the controller 800 may perform control so that the output of the transparent ice heater 430 is changed to the output of the transparent ice heater 430 in the section when the defrosting process starts.

Specifically, while the transparent ice heater 430 operates with the output of W2 in the section B, when the defrosting process starts, the output of the transparent ice heater 430 is reduced and operates with the output of W3. If the defrosting process is completed, the output of the transparent ice heater 430 may be changed to W2.

After completion of the defrosting process, the controller 800 may perform control so that the transparent ice heater 430 is turned on for the remaining time of the transparent ice heater 430 in a section when the defrosting process starts.

In the section in which the defrosting process starts, the transparent ice heater 430 has to operate with the output corresponding to the section for a first set time. The defrosting process may be started in a state in which the transparent ice heater 430 operates with the output corresponding to the section for a second set time less than the first set time.

In this case, after completion of the defrosting process, the transparent ice heater 430 may operate with the output corresponding to the section for a third set time (the first set time−the second set time) that is the remaining time.

After the transparent ice heater 430 operates for the remaining time, the controller 800 may perform control so that the heating amount of the transparent ice heater 430 is changed to the heating amount of the transparent ice heater 430 in the next section. From the next section, variable control of the output of the transparent ice heater 430 for each section before the start of the defrosting process may be performed (S28).

If the starting point of the defrosting process is a section after the intermediate section (for example, section E) among the plurality of sections (sections A to I), the controller 800 may determine that it is necessary to reduce the output of the transparent ice heater 430.

As an example, if the output of the transparent ice heater 430 in the previous section is less than the output of the transparent ice heater 430 in the section when the defrosting process starts, the controller 800 may perform control so that the output of the transparent ice heater 430 is changed to the heating amount in the previous section.

Referring to FIGS. 10 and 16(*c*), if the defrosting process starts in section G in the ice making process, the controller 800 may reduce the output of the transparent ice heater 430 and may reduce the output of the transparent ice heater 430 to the output W6 corresponding to the section F that is the previous section.

As such, by reducing the output of the transparent ice heater 430, it is possible to prevent excessive heat from being provided to the ice making cell 320*a*, and it is possible to reduce unnecessary power consumption of the transparent ice heater 430.

When the defrosting process is completed, the controller 800 may perform control so that the output of the transparent ice heater 430 is changed to the output of the transparent ice heater 430 in the section when the defrosting process starts.

Specifically, while the transparent ice heater 430 operates with the output of W7 in the section G, when the defrosting process starts, the output of the transparent ice heater 430 is reduced and operates with the output of W6.

If the defrosting process is completed, the transparent ice heater 430 may operate with the output of W7. After completion of the defrosting process, the controller 800 may perform control so that the transparent ice heater 430 is turned on for the remaining time of the transparent ice heater 430 in a section when the defrosting process starts. From the next section, variable control of the output of the transparent ice heater 430 for each section before the start of the defrosting process may be performed (S28).

As another example, whether it is necessary to reduce the heating amount of the transparent ice heater 430 may be determined based on the temperature detected by the second temperature sensor 700 after the start of the defrosting process.

That is, the output of the transparent ice heater 430 may be varied or the current output may be maintained, based on the temperature change detected by the second temperature sensor 700 after the start of the defrosting process.

For example, after the start of the defrosting process, if the temperature detected by the second temperature sensor 700 is less than the reference temperature value, the output of the transparent ice heater 430 may be maintained. On the other hand, after the start of the defrosting process, if the temperature detected by the second temperature sensor 700 is equal to or greater than the reference temperature value, the output of the transparent ice heater 430 may be reduced.

The operating time of the transparent ice heater 430 in the entire ice making section will be described. The total time for which the transparent ice heater 430 operates for ice making when the defrosting process starts is longer than the total time for which the transparent ice heater 430 operates for ice making when the defrosting process is not performed.

As described above, the operating time of the transparent ice heater 430 during the defrosting process may be added to the operating time of the transparent ice heater 430 when the defrosting process is not performed.

Referring to FIG. 16, in the normal ice making process, the temperature detected by the second temperature sensor 700 decreases as time elapses. That is, in each of the plurality of sections, the temperature has a decreasing pattern.

When the defrosting heater 920 is turned on, there is a possibility that the temperature of the ice making cell 320*a* will increase due to the heat of the defrosting heater 920.

In an embodiment, even if the defrosting heater 920 is turned on, when the change in temperature detected by the second temperature sensor 700 is small, the output of the transparent ice heater 430 may not be reduced.

On the other hand, even if the defrosting heater 920 is turned on, when the change in temperature detected by the second temperature sensor 700 is large, the output of the transparent ice heater 430 may be reduced.

For example, while the defrosting process is being performed, if the temperature value measured by the second temperature sensor 700 is greater than or equal to the reference temperature value, the transparent ice heater 430 may be turned off.

When the temperature value measured by the second temperature sensor 700 after the transparent ice heater 430 is turned off is less than the reference temperature value, the transparent ice heater 430 may be turned on again. The output of the transparent ice heater 430 may be the same as the output before the transparent ice heater 430 is turned off.

The reference temperature value may be a sub-zero temperature, 0° C., or an above-zero temperature. However, even if the reference temperature value is a sub-zero temperature, the reference temperature value may be close to 0° C.

After completion of the defrosting process, the controller 800 may perform control so that the transparent ice heater 430 is turned on for the remaining time of the transparent ice heater 430 in a section when the defrosting process starts.

When the temperature value measured by the second temperature sensor 700 after the transparent ice heater 430 is turned off is less than the reference temperature value, and thus the transparent ice heater 430 may be turned on again after being turned off, the time when the transparent ice heater 430 is turned on again may be included in the turn-on time of the transparent ice heater in the corresponding section.

For example, in one section, the transparent ice heater 430 has to operate for the first set time. In this case, the defrosting process may be started in a state in which the transparent ice heater 430 operates for the second set time less than the first set time.

While the defrosting process is being performed, the transparent ice heater 430 may be turned off and turned on again to operate for a fourth set time.

After completion of the defrosting process, the transparent ice heater 430 may operate with the output corresponding to the section for a fifth set time (the first set time−the second set time+the fourth set time) that is the remaining time.

Alternatively, if it is determined that ice is not made in the ice making cell while the defrosting process is being performed, the controller 800 may control the transparent ice heater 430 to be turned off.

If it is determined that ice is made in the ice making cell while the defrosting process is being performed, the controller 800 may control the transparent ice heater 430 to be turned on again. Of course, if it is determined that ice is made in the ice making cell while the transparent ice heater 430 is turned on, the on state of the transparent ice heater 430 may be maintained. After completion of the defrosting process, the controller 800 may perform control so that the transparent ice heater 430 is turned on for the remaining time of the transparent ice heater 430 in a section when the defrosting process starts.

Meanwhile, the holding time of the transparent ice heater 430 in the additional heating process may vary according to a period from the end of the previous ice making process to the start of the current ice making process (defrosting cycle).

For example, as the defrosting cycle is longer, the holding time may be longer. That is, as the defrosting cycle is longer, the operation time of the transparent ice heater 430 in the additional heating process may be longer.

The controller 800 may increase the operation time of the transparent ice heater 430 in the basic heating process as the defrosting cycle increases. For example, in each of the plurality of processes of the basic heating process, the first set time, which is the operation time of the transparent ice heater 430, may increase.

If the ice making cycle increases, there is a possibility that a lot of frost will grow in the evaporator and heat exchange efficiency will decrease. When the amount of frost in the evaporator increases, the air volume of the cooling fan decreases, and the ice making time may increase due to the increase in the temperature of the cold air. Accordingly, when the ice making time increases, the operation time of the transparent ice heater 430 may also increases in response to the increase in the ice making time.

The invention claimed is:

1. A refrigerator comprising:
- a storage chamber;
- a cooler configured to supply cold air into the storage chamber; and
- an ice maker comprising:
  - a first tray having a first portion of a cell;
  - a second tray having a second portion of the cell, the first portion and the second portion being configured to define a space formed by the cell to receive a liquid to be phase-changed to form ice;
  - a heater provided to supply heat to the cell; and
  - a controller configured to:
    - operate the heater while the ice is being formed so that gas bubbles dissolved in the liquid within the cell move from a portion of space where the liquid that has phase-changed into the ice to another portion of the space where the liquid is in a fluid state, and
    - in a state in which the heater operates, when a defrosting start condition is satisfied while the ice is being formed in the space of the cell, perform a defrosting process and reduce an amount of cold air supplied by the cooler,
- wherein the heater continues to be turned on during performing of the defrosting process,
- wherein the controller is configured to determine whether a reduction of an output of the heater is required during performing of the defrosting process, and
- wherein when the controller determines to reduce the output of the heater, the controller reduces the output of the heater.

2. The refrigerator of claim 1, wherein the controller is configured to:
- move the second tray to an ice making position for an ice making process after the liquid is supplied to the cell,
- move the second tray from the ice making position to an ice separation position for an ice separation process to separate the ice from the cell after completion of the ice making process, and
- supply the liquid to the space when the second tray is moved to a liquid supply position from the ice separation position after the ice separation process is completed.

3. The refrigerator of claim 1, wherein the controller controls the heater so that when a cold air transfer amount to the liquid in the space of the cell increases, the heater outputs an increase amount of heat, and when the cold air transfer amount to the liquid in the space of the cell decreases, the heater outputs a reduced amount of heat so as to maintain an ice making rate of the liquid in the space of the cell within a predetermined range that is less than an ice making rate in the space of the cell when the heater is turned off.

4. The refrigerator of claim 1, further comprising a defrosting heater configured to heat an evaporator for making the cold air,
- wherein, when the defrosting process starts, the controller turns on the defrosting heater.

5. The refrigerator of claim 4, wherein, when the defrosting heater is turned on while the heater is turned on during an ice making process, the controller controls the heater to remain turned on during at least a portion of the defrosting process.

6. The refrigerator of claim 4, wherein the controller maintains an output of the heater when the defrosting start condition is satisfied, and the output of the heater is less than or equal to a reference amount during an ice making process, and when the defrosting start condition is satisfied and the output of the heater exceeds the reference amount during the ice making process, the controller controls the output of the heater so that the output of the heater after an operation of the defrosting heater is less than the output of the heater before the operation of the defrosting heater.

7. The refrigerator of claim 4, further comprising a temperature sensor configured to sense a temperature within the space of the cell, wherein, when the defrosting heater is turned on during an ice making process, the controller maintains an output of the heater when the temperature sensed by the temperature sensor is less than a reference value, and when the temperature sensed by the temperature sensor is greater than or equal to the reference value, the controller reduces the output of the heater so that the output of the heater after operation of the defrosting heater is less than the output of the heater before the operation of the defrosting heater.

8. The refrigerator of claim 4, wherein a total time for which the heater operates for ice making when the defrosting process starts is longer than a total time for which the heater operates for ice making when the defrosting process is not being performed.

9. The refrigerator of claim 1, wherein the cooler includes a compressor and a fan configured to blow cold air, and at least one of the compressor or the fan is turned off in the defrosting process.

10. The refrigerator of claim 1, wherein a pre-defrosting process is performed before the defrosting process, the cooler supplies an amount of cold air during the pre-defrosting process which is increased to be more than an amount of cold air supplied by the cooler before the defrosting start condition is satisfied, and the heater provides an increased amount of heat in response to the increased amount of cold air supplied by the cooler during the pre-defrosting process.

11. The refrigerator of claim 1, wherein a post-defrosting process is performed after the defrosting process, the cooler supplies an increased amount of cold air during the post-defrosting process that is more than the amount of cold air supplied by the cooler before the defrosting start condition is satisfied, and the heater provides an increased amount of heat in response to the increased amount of cold air supplied by the cooler during the post-defrosting process.

12. The refrigerator of claim 1, wherein the output of the heater varies according to respective mass per unit height values of liquid in a plurality of sections of the space of the cell.

13. The refrigerator of claim 12, wherein a reference output of the heater in each of the plurality of sections is predetermined, and when the space of the cell has a spherical shape, the output of the heater decreases and then increases during an ice making process.

14. The refrigerator of claim 13, wherein, when the defrosting process starts in the ice making process, the controller determines whether to reduce the output of the heater, and when the controller determines to reduce the output of the heater, the controller reduces the output of the heater.

15. The refrigerator of claim 14, wherein the controller maintains the output of the heater when the output of the heater is minimum.

16. The refrigerator of claim 1, wherein at least one of the first tray or the second tray is made of a non-metal material so as to reduce a heat transfer rate of the heater.

17. The refrigerator of claim 1, wherein the defrosting process includes a pre-defrosting process, and a heat input process performed after the pre-defrosting process, and wherein the controller reduces the output of the heater in the heat input process.

18. A refrigerator comprising:

a storage chamber;

a cooler including an evaporator and configured to supply cold air into the storage chamber; and an ice maker comprising:

a tray having a first portion and a second portion of a cell, the second portion being movable relative to the first portion, and the first portion and the second portion being configured to define a space formed by the cell to receive a liquid to be phase-changed to form ice;

a first heater provided to supply heat to the cell; and a second heater configured to heat the evaporator, wherein in an ice making process, the first heater operates to heat the cell such that gas bubbles dissolved in the liquid within the cell move from a portion of space where the liquid that has phase-changed into the ice to another portion of the space where the liquid is in a fluid state, wherein, when the second heater is turned on while the first heater operating in connection with forming the ice in the space of the cell, the first heater continues to be turned on during at least a portion of a time that the second heater is turned on.

19. The refrigerator of claim 18, wherein the cooler includes a compressor and a fan, and at least one of the compressor or the fan is turned off when the second heater is turned on.

20. The refrigerator of claim 18, wherein the output of the first heater is reduced after the second heater is turned on.

21. A refrigerator comprising:

a storage chamber;

a cooler configured to supply cold air into the storage chamber; and an ice maker comprising:

a tray having a first portion and a second portion of a cell, the second portion being movable relative to the first portion, and the first portion and the second portion being configured to define a space formed by the cell to receive a liquid to be phase-changed to form ice;

a heater provided to supply heat to the cell while the ice is being formed in the cell, and a temperature sensor configured to sense a temperature within the space of the cell, wherein, when a defrosting process starts while the heater is turned on in connection with forming the ice in the space of the cell, a heat output of the heater is maintained when the temperature sensed by the temperature sensor is less than a reference value during the defrosting process, and the heat output of the heater is reduced when the temperature sensed by the temperature sensor is greater than or equal to the reference value during the defrosting process.

22. A refrigerator comprising:

a storage chamber;

a cooler configured to supply cold air into the storage chamber; and an ice maker comprising:

a tray having a first portion and a second portion of a cell, the second portion being movable relative to the first portion, and the first portion and the second portion being configured to define a space formed by the cell to receive a liquid to be phase-changed to form ice;

a heater provided to supply heat to the cell while the ice is being formed in the cell, and a controller configured to:

operate the heater while the ice is being formed so that gas bubbles dissolved in the liquid within the cell move from a portion of space where the liquid that has phase-changed into the ice to another portion of the space where the liquid is in a fluid state, and in a state in which the heater operates, when a defrosting start condition is satisfied while the ice is being formed in the space of the cell, perform a defrosting process, wherein the heater continues to be turned on during performing of the defrosting process and the controller is configured to reduce an output of the heater.

23. The refrigerator of claim 22, wherein the controller is configured to increase the output of the heater after reduction of the output of the heater.

* * * * *